US008512130B2

(12) United States Patent
Muir

(10) Patent No.: US 8,512,130 B2
(45) Date of Patent: Aug. 20, 2013

(54) GAMING SYSTEM WITH LINKED GAMING MACHINES THAT ARE CONFIGURABLE TO HAVE A SAME PROBABILITY OF WINNING A DESIGNATED AWARD

(75) Inventor: David H. Muir, Warnesbay (AU)

(73) Assignee: IGT, Las Vegas, NV (US)

( * ) Notice: Subject to any disclaimer, the term of this patent is extended or adjusted under 35 U.S.C. 154(b) by 1518 days.

(21) Appl. No.: 11/460,490

(22) Filed: Jul. 27, 2006

(65) Prior Publication Data

US 2008/0026824 A1 Jan. 31, 2008

(51) Int. Cl.
*A63F 9/00* (2006.01)

(52) U.S. Cl.
USPC ..... 463/25

(58) Field of Classification Search
USPC ..... 463/25
See application file for complete search history.

(56) References Cited

U.S. PATENT DOCUMENTS

| | | | |
|---|---|---|---|
| 4,335,809 | A | 6/1982 | Wain |
| 4,448,419 | A | 5/1984 | Telnaes |
| 4,572,509 | A | 2/1986 | Sitrick |
| 4,582,324 | A | 4/1986 | Koza et al. |
| 4,652,998 | A | 3/1987 | Koza et al. |
| 4,679,143 | A | 7/1987 | Hagiwara |
| 4,695,053 | A | 9/1987 | Vazquez, Jr. et al. |
| 4,711,451 | A | 12/1987 | Pajak et al. |
| 4,842,278 | A | 6/1989 | Markowicz |
| 4,856,787 | A | 8/1989 | Itkis |
| 4,866,515 | A | 9/1989 | Tagawa et al. |
| 4,924,378 | A | 5/1990 | Hershey et al. |
| 4,991,848 | A | 2/1991 | Greenwood et al. |
| 5,116,055 | A | 5/1992 | Tracy |
| 5,123,649 | A | 6/1992 | Tiberio |
| 5,138,712 | A | 8/1992 | Corbin |
| 5,142,622 | A | 8/1992 | Owens |
| 5,178,390 | A | 1/1993 | Okada |
| 5,179,517 | A | 1/1993 | Sarbin et al. |

(Continued)

FOREIGN PATENT DOCUMENTS

| | | |
|---|---|---|
| EP | 0843272 | 5/1998 |
| EP | 1004970 | 5/2000 |

(Continued)

OTHER PUBLICATIONS

Bally Live-Server Based Gaming brochure, written by Bally Gaming Systems, published in 2006.

(Continued)

*Primary Examiner* — Melba Bumgarner
*Assistant Examiner* — Seng H Lim
(74) *Attorney, Agent, or Firm* — Neal, Gerber & Eisenberg LLP

(57) ABSTRACT

A gaming system that is controlled by a central controller and includes a plurality of gaming machines. Each of the gaming machines includes a game operable upon a wager by a player, a plurality of winning symbol combinations including a designated winning symbol combination and a probability of achieving the designated winning symbol combination. At least two of the gaming machines have different probabilities of achieving the designated winning symbol combination. The gaming system includes a designated award and a triggering event. After an occurrence of the triggering event, the central controller is programmed to change the probability of achieving the designated winning symbol combination for at least one of the gaming machines such that each gaming machine has an equal probability of generating the designated winning symbol combination.

56 Claims, 8 Drawing Sheets

(56) References Cited

U.S. PATENT DOCUMENTS 5,276,312 A 1/1994 McCarthy
5,280,909 A 1/1994 Tracy
5,286,023 A 2/1994 Wood
5,288,978 A 2/1994 Iijima
5,305,195 A 4/1994 Murphy
5,344,144 A 9/1994 Canon
5,349,642 A 9/1994 Kingdon
5,375,206 A 12/1994 Hunter et al.
5,377,993 A 1/1995 Josephs
5,380,007 A 1/1995 Travis et al.
5,404,567 A 4/1995 DePietro et al.
5,429,361 A 7/1995 Raven et al.
5,430,791 A 7/1995 Feit et al.
5,438,508 A 8/1995 Wyman
5,465,082 A 11/1995 Chaco
5,499,340 A 3/1996 Barritz
5,507,491 A 4/1996 Gatto et al.
5,511,781 A 4/1996 Wood et al.
5,524,888 A * 6/1996 Heidel ..... 463/22
5,530,232 A 6/1996 Taylor
5,536,016 A 7/1996 Thompson
5,542,669 A 8/1996 Charron et al.
5,551,692 A 9/1996 Pettit et al.
5,559,313 A 9/1996 Claus et al.
5,560,603 A 10/1996 Seelig et al.
5,564,700 A 10/1996 Celona
5,566,337 A 10/1996 Szymanski et al.
5,578,808 A 11/1996 Taylor
5,586,257 A 12/1996 Perlman
5,586,937 A 12/1996 Menashe
5,611,730 A 3/1997 Weiss
5,617,331 A 4/1997 Wakai et al.
5,626,341 A 5/1997 Jones et al.
5,630,757 A 5/1997 Gagin et al.
5,640,192 A 6/1997 Garfinkle
5,643,086 A 7/1997 Alcorn et al.
5,645,486 A 7/1997 Nagao et al.
5,649,118 A 7/1997 Carlisle et al.
5,655,603 A 8/1997 Schulte et al.
5,655,961 A 8/1997 Acres et al.
5,664,998 A 9/1997 Seelig et al.
5,671,412 A 9/1997 Christiano
5,702,304 A 12/1997 Acres et al.
5,708,709 A 1/1998 Rose
5,709,603 A 1/1998 Kaye
5,711,525 A 1/1998 Breeding
5,717,604 A 2/1998 Wiggins
5,741,183 A 4/1998 Acres et al.
5,745,879 A 4/1998 Wyman
5,752,882 A 5/1998 Acres et al.
5,755,621 A 5/1998 Marks et al.
5,758,069 A 5/1998 Olsen
5,759,102 A 6/1998 Pease et al.
5,762,552 A 6/1998 Vuong et al.
5,766,076 A 6/1998 Pease et al.
5,768,382 A 6/1998 Schneier et al.
5,779,545 A 7/1998 Berg et al.
5,779,549 A 7/1998 Walker et al.
5,788,573 A 8/1998 Baerlocher
5,800,268 A 9/1998 Molnick
5,806,855 A 9/1998 Cherry
5,807,172 A 9/1998 Piechowiak
5,820,459 A 10/1998 Acres et al.
5,828,840 A 10/1998 Cowan et al.
5,833,538 A 11/1998 Weiss
5,833,540 A 11/1998 Miodunski et al.
5,836,817 A 11/1998 Acres et al.
5,845,283 A 12/1998 Williams et al.
5,851,011 A 12/1998 Lott
5,851,147 A 12/1998 Stupak et al.
5,851,149 A 12/1998 Xidos et al.
5,855,515 A 1/1999 Pease et al.
5,871,398 A 2/1999 Schneier et al.
5,876,284 A 3/1999 Acres et al.
5,885,158 A 3/1999 Torango et al.
5,902,184 A 5/1999 Bennett et al.
5,903,732 A 5/1999 Reed et al.
5,905,248 A 5/1999 Russell et al.
5,910,048 A 6/1999 Feinberg
5,913,164 A 6/1999 Pawa et al.
5,917,725 A 6/1999 Thacher et al.
5,918,039 A 6/1999 Buswell et al.
5,925,127 A 7/1999 Ahmad
5,941,773 A 8/1999 Harlick
5,947,820 A 9/1999 Morro et al.
5,947,822 A 9/1999 Weiss
5,951,011 A 9/1999 Potter et al.
5,951,611 A 9/1999 La Pierre
5,967,894 A 10/1999 Kinoshita et al.
5,971,271 A 10/1999 Wynn et al.
5,971,849 A 10/1999 Falciglia
5,974,409 A 10/1999 Sanu et al.
5,980,093 A 11/1999 Jones et al.
5,980,384 A 11/1999 Barrie
5,983,190 A 11/1999 Trower, II et al.
5,991,760 A 11/1999 Gauvin et al.
5,991,790 A 11/1999 Shah et al.
5,996,068 A 11/1999 Dwyer, III et al.
5,997,401 A 12/1999 Crawford
5,999,808 A 12/1999 La Due
6,001,016 A 12/1999 Walker et al.
6,003,066 A 12/1999 Ryan et al.
6,003,094 A 12/1999 Dean
6,003,123 A 12/1999 Carter et al.
6,011,850 A 1/2000 Bertrand et al.
6,012,982 A 1/2000 Piechowiak et al.
6,024,640 A 2/2000 Walker et al.
6,033,307 A 3/2000 Vancura
6,053,813 A 4/2000 Mathis
6,059,289 A 5/2000 Vancura
6,068,552 A 5/2000 Walker et al.
6,068,982 A 5/2000 Rolfe et al.
6,071,190 A 6/2000 Weiss et al.
6,085,247 A 7/2000 Parsons, Jr. et al.
6,089,975 A 7/2000 Dunn
6,089,982 A 7/2000 Holch et al.
6,099,408 A 8/2000 Schneier et al.
6,106,396 A 8/2000 Alcorn et al.
6,108,420 A 8/2000 Larose et al.
6,110,041 A 8/2000 Walker et al.
6,110,043 A 8/2000 Olsen
6,113,098 A 9/2000 Adams
6,113,495 A 9/2000 Walker et al.
6,117,012 A 9/2000 McCrea, Jr.
6,117,013 A 9/2000 Eiba
6,129,632 A 10/2000 Laciano
6,135,884 A 10/2000 Hedrick et al.
6,135,887 A 10/2000 Pease et al.
6,141,737 A 10/2000 Krantz et al.
6,142,872 A 11/2000 Walker et al.
6,146,273 A 11/2000 Olsen
6,149,522 A 11/2000 Alcorn et al.
6,151,707 A 11/2000 Hecksel et al.
6,155,925 A 12/2000 Giobbi et al.
6,159,097 A 12/2000 Gura
6,159,098 A 12/2000 Slominary et al.
6,162,122 A 12/2000 Acres et al.
6,174,233 B1 1/2001 Sunaga et al.
6,206,782 B1 3/2001 Walker et al.
6,219,836 B1 4/2001 Wells et al.
6,224,483 B1 5/2001 Mayeroff
6,224,486 B1 5/2001 Walker et al.
6,241,608 B1 6/2001 Torango
6,244,957 B1 6/2001 Walker et al.
6,251,014 B1 6/2001 Stockdale et al.
6,254,483 B1 7/2001 Acres
6,257,981 B1 7/2001 Acres et al.
6,264,561 B1 7/2001 Saffari et al.
6,287,200 B1 9/2001 Sharma
6,287,202 B1 9/2001 Pascal et al.
6,293,866 B1 9/2001 Walker et al.
6,304,905 B1 10/2001 Clark
6,308,271 B2 10/2001 Tanaka
6,312,332 B1 11/2001 Walker et al.

6,312,333 B1 11/2001 Acres
6,319,122 B1 11/2001 Packes, Jr. et al.
6,319,125 B1 11/2001 Acres
6,334,612 B1 1/2002 Wurz et al.
6,336,857 B1 1/2002 McBride
6,345,386 B1 2/2002 Delo et al.
6,353,928 B1 3/2002 Altberg et al.
6,354,946 B1 3/2002 Finn
6,358,150 B1 3/2002 Mir et al.
6,361,437 B1 3/2002 Walker et al.
6,361,441 B1 3/2002 Walker et al.
6,364,314 B1 4/2002 Canterbury
6,368,216 B1 4/2002 Hedrick et al.
6,383,074 B1 5/2002 Boggs
6,389,538 B1 5/2002 Gruse et al.
6,389,589 B1 5/2002 Mishra et al.
6,394,902 B1 5/2002 Glavich et al.
6,394,907 B1 5/2002 Rowe
6,397,381 B1 5/2002 Delo et al.
6,402,614 B1 6/2002 Schneier et al.
6,409,602 B1 6/2002 Wiltshire et al.
6,418,554 B1 7/2002 Delo et al.
6,425,828 B2 7/2002 Walker et al.
6,427,227 B1 7/2002 Chamberlain
6,439,996 B2 8/2002 LeMay et al.
6,442,529 B1 8/2002 Krishan et al.
6,443,839 B2 9/2002 Stockdale et al.
6,450,887 B1 9/2002 Mir et al.
6,457,175 B1 9/2002 Lerche
RE37,885 E 10/2002 Acres et al.
6,488,585 B1 12/2002 Wells et al.
6,503,146 B2 1/2003 Walker et al.
6,503,147 B1 1/2003 Stockdale et al.
6,508,710 B1 1/2003 Paravia et al.
6,523,166 B1 2/2003 Mishra et al.
6,527,638 B1 3/2003 Walker et al.
6,532,543 B1 3/2003 Smith et al.
6,533,664 B1 3/2003 Crumby
6,565,434 B1 5/2003 Acres
6,575,832 B1 6/2003 Manfredi et al.
6,578,199 B1 6/2003 Tsou et al.
6,592,457 B1 7/2003 Frohm et al.
6,595,856 B1 7/2003 Ginsburg et al.
6,599,193 B2 7/2003 Baerlocher et al.
6,607,439 B2 8/2003 Schneier et al.
6,609,978 B1 8/2003 Paulsen
6,620,047 B1 9/2003 Alcorn et al.
6,628,939 B2 9/2003 Paulsen
6,638,170 B1 10/2003 Crumby
6,645,077 B2 11/2003 Rowe
6,648,758 B2 * 11/2003 Bennett et al. ..... 463/20
6,656,046 B1 * 12/2003 Yoseloff et al. ..... 463/20
6,682,423 B2 1/2004 Brosnan et al.
6,685,567 B2 2/2004 Cockerille et al.
6,712,693 B1 3/2004 Hettinger
6,712,699 B2 3/2004 Walker et al.
6,712,702 B2 3/2004 Goldberg et al.
6,722,986 B1 4/2004 Lyons et al.
6,733,390 B2 5/2004 Walker et al.
6,746,327 B2 6/2004 Frohm et al.
6,749,510 B2 6/2004 Giobbi
6,769,986 B2 8/2004 Vancura
6,782,477 B2 8/2004 McCarroll
6,790,142 B2 9/2004 Okada et al.
6,790,143 B2 9/2004 Crumby
6,802,778 B1 10/2004 LeMay et al.
6,804,763 B1 10/2004 Stockdale et al.
6,805,634 B1 10/2004 Wells et al.
6,811,488 B2 11/2004 Paravia et al.
6,813,765 B1 11/2004 Flores
6,816,882 B1 11/2004 Conner et al.
6,817,944 B2 11/2004 Kaminkow et al.
6,823,456 B1 11/2004 Dan et al.
6,830,515 B2 12/2004 Rowe
6,832,958 B2 12/2004 Acres et al.
6,834,245 B2 12/2004 Ota et al.
6,836,794 B1 12/2004 Lucovsky et al.
6,843,723 B2 1/2005 Joshi
6,843,725 B2 1/2005 Nelson
6,846,238 B2 1/2005 Wells
6,852,031 B1 2/2005 Rowe
6,855,054 B2 2/2005 White et al.
6,855,057 B2 2/2005 Namba et al.
6,857,959 B1 2/2005 Nguyen
6,863,608 B1 3/2005 LeMay et al.
6,866,581 B2 3/2005 Martinek et al.
6,866,584 B2 3/2005 Michaelson
6,866,586 B2 3/2005 Oberberger et al.
6,875,109 B2 4/2005 Stockdale
6,875,110 B1 4/2005 Crumby
6,878,063 B2 4/2005 Manfredi et al.
6,884,162 B2 4/2005 Raverdy et al.
6,884,166 B2 4/2005 Leen et al.
6,884,170 B2 4/2005 Rowe
6,884,171 B2 4/2005 Eck et al.
6,884,173 B2 4/2005 Gauselmann
6,884,174 B2 4/2005 Lundy et al.
6,887,151 B2 5/2005 Leen et al.
6,887,156 B2 5/2005 DeWeese et al.
6,889,159 B2 5/2005 Klotz et al.
6,890,256 B2 5/2005 Walker et al.
6,896,616 B2 5/2005 Weiss
6,896,618 B2 5/2005 Benoy et al.
6,899,627 B2 5/2005 Lam et al.
6,899,628 B2 5/2005 Leen et al.
6,901,375 B2 5/2005 Fernandez
6,902,481 B2 6/2005 Breckner et al.
6,908,391 B2 6/2005 Gatto et al.
6,910,965 B2 6/2005 Downes
6,939,234 B2 9/2005 Beatty
6,942,571 B1 9/2005 McAllister et al.
6,945,870 B2 9/2005 Gatto et al.
6,960,134 B2 * 11/2005 Hartl et al. ..... 463/20
6,991,544 B2 1/2006 Soltys et al.
7,029,395 B1 4/2006 Baerlcoher
7,051,004 B2 5/2006 Nuttal et al.
7,111,845 B2 * 9/2006 Walker et al. ..... 273/292
7,255,645 B2 * 8/2007 Steil et al. ..... 463/27
7,597,621 B2 10/2009 Baerlocher
7,674,175 B2 * 3/2010 Yoshimura ..... 463/20
2001/0036857 A1 11/2001 Mothwurf et al.
2001/0044337 A1 11/2001 Rowe et al.
2001/0046893 A1 11/2001 Giobbi et al.
2001/0055990 A1 12/2001 Acres
2002/0025846 A1 * 2/2002 Bennett et al. ..... 463/20
2002/0032049 A1 3/2002 Walker et al.
2002/0045484 A1 4/2002 Eck et al.
2002/0057800 A1 5/2002 Gordon et al.
2002/0058546 A2 5/2002 Acres
2002/0068629 A1 6/2002 Allen et al.
2002/0068631 A1 6/2002 Raverdy et al.
2002/0071557 A1 6/2002 Nguyen
2002/0071560 A1 6/2002 Kurn et al.
2002/0080969 A1 6/2002 Giobbi
2002/0116615 A1 8/2002 Nguyen et al.
2002/0137217 A1 9/2002 Rowe
2002/0138594 A1 9/2002 Rowe
2002/0144116 A1 10/2002 Giobbi
2002/0151360 A1 10/2002 Durham et al.
2002/0160826 A1 10/2002 Gomez et al.
2002/0169022 A1 11/2002 Canterbury
2002/0173355 A1 11/2002 Walker et al.
2002/0174160 A1 11/2002 Gatto et al.
2002/0174444 A1 11/2002 Gatto et al.
2002/0177483 A1 11/2002 Cannon
2002/0188940 A1 12/2002 Breckner et al.
2003/0027625 A1 2/2003 Rowe
2003/0027638 A1 2/2003 Schneider et al.
2003/0045351 A1 3/2003 Gauselmann
2003/0045354 A1 3/2003 Giobbi
2003/0054879 A1 3/2003 Schneier et al.
2003/0060286 A1 3/2003 Walker et al.
2003/0064771 A1 4/2003 Morrow et al.
2003/0064807 A1 4/2003 Walker et al.
2003/0069058 A1 4/2003 Byrne et al.
2003/0073497 A1 4/2003 Nelson
2003/0078094 A1 4/2003 Gatto et al.
2003/0078101 A1 4/2003 Schneider et al.

2003/0092489 A1 5/2003 Veradej
2003/0093669 A1 5/2003 Morais et al.
2003/0100359 A1 5/2003 Loose et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0115351 A1 6/2003 Giobbi
2003/0119579 A1* 6/2003 Walker et al. ..... 463/20
2003/0140134 A1 7/2003 Swanson et al.
2003/0162589 A1 8/2003 Nguyen et al.
2003/0171149 A1 9/2003 Rothschild
2003/0176219 A1 9/2003 Manfredi et al.
2003/0181231 A1* 9/2003 Vancura et al. ..... 463/9
2003/0188306 A1 10/2003 Harris et al.
2003/0190941 A1 10/2003 Byrne
2003/0195033 A1 10/2003 Gazdic et al.
2003/0216166 A1 11/2003 Baerlocher et al.
2003/0216169 A1* 11/2003 Walker et al. ..... 463/25
2003/0216182 A1 11/2003 Gauselmann
2003/0224852 A1 12/2003 Walker et al.
2003/0228904 A1 12/2003 Acres et al.
2003/0228907 A1 12/2003 Gatto et al.
2003/0228912 A1 12/2003 Wells et al.
2003/0232650 A1 12/2003 Beatty
2004/0002381 A1 1/2004 Alcorn et al.
2004/0002385 A1 1/2004 Nguyen
2004/0003389 A1 1/2004 Reynar et al.
2004/0005919 A1 1/2004 Walker et al.
2004/0010700 A1 1/2004 Mont
2004/0015423 A1 1/2004 Walker et al.
2004/0023721 A1 2/2004 Giobbi
2004/0024666 A1 2/2004 Walker et al.
2004/0029635 A1 2/2004 Giobbi
2004/0038723 A1 2/2004 Schneier et al.
2004/0038735 A1* 2/2004 Steil et al. ..... 463/27
2004/0048660 A1 3/2004 Gentles et al.
2004/0048667 A1 3/2004 Rowe
2004/0053664 A1 3/2004 Byrne
2004/0053683 A1* 3/2004 Hartl et al. ..... 463/25
2004/0054952 A1 3/2004 Morrow et al.
2004/0063489 A1 4/2004 Crumby
2004/0072604 A1 4/2004 Toyoda
2004/0072608 A1 4/2004 Toyoda
2004/0082385 A1 4/2004 Silva et al.
2004/0092310 A1 5/2004 Brosnan et al.
2004/0098597 A1 5/2004 Giobbi
2004/0106452 A1 6/2004 Nguyen et al.
2004/0124243 A1 7/2004 Gatto et al.
2004/0127279 A1 7/2004 Gatto et al.
2004/0132532 A1 7/2004 Brosnan et al.
2004/0133485 A1 7/2004 Schoonmaker et al.
2004/0142739 A1 7/2004 Loose et al.
2004/0142742 A1 7/2004 Schneider et al.
2004/0152509 A1 8/2004 Hornik et al.
2004/0152511 A1 8/2004 Nicely et al.
2004/0162144 A1 8/2004 Loose et al.
2004/0166923 A1 8/2004 Michaelson et al.
2004/0166940 A1 8/2004 Rothschild
2004/0166942 A1 8/2004 Muir
2004/0176162 A1 9/2004 Rothschild
2004/0176167 A1 9/2004 Michaelson et al.
2004/0179701 A1 9/2004 Boyd
2004/0180721 A1 9/2004 Rowe
2004/0180722 A1 9/2004 Giobbi
2004/0185936 A1 9/2004 Block et al.
2004/0193726 A1 9/2004 Gatto et al.
2004/0198494 A1 10/2004 Nguyen et al.
2004/0198496 A1 10/2004 Gatto et al.
2004/0204244 A1 10/2004 Rathsack et al.
2004/0214622 A1 10/2004 Atkinson
2004/0214627 A1 10/2004 Jordan et al.
2004/0214640 A1 10/2004 Giobbi
2004/0214641 A1 10/2004 Giobbi
2004/0215756 A1 10/2004 VanAntwerp et al.
2004/0219967 A1 11/2004 Giobbi et al.
2004/0219968 A1 11/2004 Fiden et al.
2004/0219983 A1 11/2004 Giobbi
2004/0224770 A1 11/2004 Wolf et al.
2004/0229684 A1 11/2004 Blackburn et al.
2004/0229698 A1 11/2004 Lind et al.
2004/0229699 A1 11/2004 Gentles et al.
2004/0235559 A1 11/2004 Brosnan et al.
2004/0235563 A1 11/2004 Blackburn et al.
2004/0242298 A1 12/2004 Inamura et al.
2004/0242313 A1 12/2004 Munoz
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248642 A1 12/2004 Rothschild
2004/0248645 A1 12/2004 Blackburn et al.
2004/0248646 A1 12/2004 Canterbury
2004/0248651 A1 12/2004 Gagner
2004/0254006 A1 12/2004 Lam et al.
2004/0254013 A1 12/2004 Quraishi et al.
2004/0254014 A1 12/2004 Quraishi et al.
2004/0254954 A1 12/2004 Gatto et al.
2004/0255139 A1 12/2004 Giobbi
2004/0259627 A1* 12/2004 Walker et al. ..... 463/20
2004/0259629 A1 12/2004 Michaelson et al.
2004/0259633 A1 12/2004 Gentles et al.
2004/0259640 A1 12/2004 Gentles et al.
2004/0259643 A1 12/2004 Gentles
2004/0266532 A1 12/2004 Blackburn et al.
2004/0266533 A1 12/2004 Gentles et al.
2005/0003886 A1 1/2005 Englman et al.
2005/0009599 A1 1/2005 Ryan
2005/0009601 A1 1/2005 Manfredi et al.
2005/0009607 A1 1/2005 Russell et al.
2005/0010738 A1 1/2005 Stockdale et al.
2005/0014559 A1 1/2005 Mattice et al.
2005/0032573 A1 2/2005 Acres et al.
2005/0032577 A1 2/2005 Blackburn et al.
2005/0037708 A1 2/2005 Torvinen
2005/0043072 A1 2/2005 Nelson
2005/0043088 A1 2/2005 Nguyen et al.
2005/0043090 A1 2/2005 Pryzby et al.
2005/0043094 A1 2/2005 Nguyen et al.
2005/0044535 A1 2/2005 Coppert
2005/0049037 A1 3/2005 Anderson et al.
2005/0054431 A1 3/2005 Walker et al.
2005/0054438 A1 3/2005 Rothschild et al.
2005/0054445 A1 3/2005 Gatto et al.
2005/0054447 A1 3/2005 Hiroyama et al.
2005/0054448 A1 3/2005 Frerking et al.
2005/0059457 A1 3/2005 Rothschild et al.
2005/0059493 A1 3/2005 Tyson et al.
2005/0059494 A1 3/2005 Kammler
2005/0064939 A1 3/2005 McSheffrey et al.
2005/0075983 A1 4/2005 St. Denis
2005/0081623 A1 4/2005 Frank
2005/0086286 A1 4/2005 Gatto et al.
2005/0090313 A1 4/2005 Rowe
2005/0096114 A1 5/2005 Cannon et al.
2005/0096130 A1* 5/2005 Mullins ..... 463/27
2005/0096133 A1 5/2005 Hoefelmeyer et al.
2005/0097342 A1 5/2005 Gatto et al.
2005/0101370 A1 5/2005 Lind et al.
2005/0113172 A1 5/2005 Gong
2005/0114272 A1 5/2005 Herrmann et al.
2005/0119045 A1 6/2005 Fujimoto
2005/0119046 A1 6/2005 Fujimoto
2005/0137012 A1 6/2005 Michaelson
2005/0148385 A1 7/2005 Michaelson
2005/0239539 A1* 10/2005 Inamura ..... 463/20
2005/0261060 A1 11/2005 Nguyen et al.
2005/0261061 A1 11/2005 Nguyen et al.
2005/0282629 A1 12/2005 Gagner
2005/0282638 A1 12/2005 Rowe
2006/0009273 A2 1/2006 Moshal
2006/0019747 A1 1/2006 Loose et al.
2006/0030390 A1* 2/2006 Okada ..... 463/16
2006/0030409 A1 2/2006 Lechner et al.
2006/0031829 A1 2/2006 Harris et al.
2006/0036573 A1 2/2006 Watanabe et al.

| | | | | |
|---|---|---|---|---|
| 2006/0039132 | A1 | 2/2006 | Chen | |
| 2006/0073877 | A1* | 4/2006 | Rodgers et al. | 463/20 |
| 2006/0073884 | A1* | 4/2006 | Walker et al. | 463/25 |
| 2006/0084502 | A1 | 4/2006 | Downs, III et al. | |
| 2006/0094508 | A1 | 5/2006 | D'Amico et al. | |
| 2006/0128463 | A1* | 6/2006 | Okada | 463/29 |
| 2006/0160607 | A1* | 7/2006 | Okada | 463/21 |
| 2006/0194633 | A1 | 8/2006 | Paulsen | |
| 2006/0211489 | A1* | 9/2006 | Walker et al. | 463/25 |
| 2006/0258422 | A1* | 11/2006 | Walker et al. | 463/7 |
| 2006/0287107 | A1 | 12/2006 | Okada | |
| 2007/0004508 | A1* | 1/2007 | Walker et al. | 463/29 |
| 2007/0060271 | A1 | 3/2007 | Cregan et al. | |
| 2007/0105611 | A1* | 5/2007 | O'Halloran | 463/16 |
| 2007/0275777 | A1* | 11/2007 | Walker et al. | 463/16 |
| 2008/0009341 | A1* | 1/2008 | Walker et al. | 463/25 |
| 2008/0026822 | A1* | 1/2008 | Walker et al. | 463/25 |
| 2008/0039191 | A1 | 2/2008 | Cuddy | |
| 2008/0070667 | A1* | 3/2008 | Lutnick et al. | 463/16 |
| 2008/0108423 | A1 | 5/2008 | Benbrahim et al. | |
| 2008/0161101 | A1* | 7/2008 | Lutnick et al. | 463/25 |
| 2008/0248865 | A1* | 10/2008 | Tedesco et al. | 463/25 |
| 2009/0298595 | A1* | 12/2009 | Okuaki | 463/42 |

FOREIGN PATENT DOCUMENTS

| | | |
|---|---|---|
| EP | 1199690 | 2/2004 |
| EP | 0813132 | 1/2005 |
| EP | 1378873 | 3/2005 |
| EP | 1238688 | 5/2005 |
| EP | 1378874 | 5/2005 |
| EP | 1471710 | 5/2005 |
| EP | 1291048 | 6/2005 |
| GB | 2 098 778 | 11/1982 |
| WO | WO 9835309 | 8/1998 |
| WO | WO 9941718 | 8/1999 |
| WO | WO 9965579 | 12/1999 |
| WO | WO 0025281 | 5/2000 |
| WO | WO 0161437 | 8/2001 |
| WO | WO 03045515 | 6/2003 |
| WO | WO 03045516 | 6/2003 |
| WO | WO 2004004855 | 1/2004 |
| WO | WO 2004103495 | 12/2004 |
| WO | WO 2005028056 | 3/2005 |
| WO | WO 2005029220 | 3/2005 |
| WO | WO 2005033825 | 4/2005 |
| WO | WO 2005033826 | 4/2005 |
| WO | WO 2005120672 | 12/2005 |
| WO | WO 2006039067 | 4/2006 |

OTHER PUBLICATIONS

Bonusing Solutions without Limits brochure, written by Bally Gaming Systems, published in 2005.
Cash Express Advertisement, written by Aristocrat, published in 2001.
Dragon's Gold Advertisement, written by IGT, published in 2002.
Dragon's Gold Article, written by IGT, published by Strictly Slots in Feb. 2003.
Jackpot Carnival Hyperlink Advertisement, written by Aristocrat, published prior to Jul. 2006.
Megabucks Advertisement, written by IGT, published prior to Jul. 2006.
Penny Megabucks Advertisement, written by IGT, published prior to Jul. 2006.
SB Products—The Next Big Innovation, printed from www.igt.com in Aug. 2006.
Server Based: Other Possibilities Article; published by www.casinocenter.com in May 2006.
Transforming Gaming Brochure, written by Cyberview Technology, published in 2006.
Wheel of Fortune Triple Action Article, written by IGT, published by Strictly Slots in Feb. 2004.
Wheel of Fortune Advertisement, written by IGT, published in 1998.
Wheel of Fortune Special Edition Advertisement, written by IGT, published in 2004.
Wheel of Fortune Special Edition Article, written by IGT, published by Strictly Slots in Jan. 2003.
Wheel of Fortune Video Advertisement, written by IGT, published in 1999.

* cited by examiner

FIG. 5A

120

| Gaming Device 1: Winning Combination: 777 | | | |
|---|---|---|---|
| Number of 7's on Reel 1 | Number of 7's on Reel 2 | Number of 7's on Reel 3 | Chance of Generating the Winning Combination of 7,7,7 |
| 1 | 1 | 1 | 0.0000939 |
| 2 | 1 | 1 | 0.000187 |
| 1 | 2 | 1 | 0.000187 |
| 1 | 1 | 2 | 0.000187 |
| 4 | 2 | 4 | 0.0015 |
| 10 | 5 | 8 | 0.0376 |
| 15 | 5 | 18 | 0.1268 |

FIG. 5B

122

| Gaming Device 2: Winning Combination: Orange Orange Orange | | | |
|---|---|---|---|
| Number of Orange's on Reel 1 | Number of Orange's on Reel 2 | Number of Orange's on Reel 3 | Chance of Generating the Winning Combination of Orange, Orange, Orange |
| 1 | 1 | 1 | 0.0000939 |
| 2 | 1 | 1 | 0.000187 |
| 1 | 2 | 1 | 0.000187 |
| 1 | 1 | 2 | 0.000187 |
| 4 | 2 | 4 | 0.0015 |
| 10 | 5 | 8 | 0.0376 |
| 15 | 5 | 18 | 0.1268 |

FIG. 5C

124

| Gaming Device 3: Winning Combination: Bar Bar Bar | | | |
|---|---|---|---|
| Number of Bar's on Reel 1 | Number of Bar's on Reel 2 | Number of Bar's on Reel 3 | Chance of Generating the Winning Combination of Bar, Bar, Bar |
| 1 | 1 | 1 | 0.0000939 |
| 2 | 1 | 1 | 0.000187 |
| 1 | 2 | 1 | 0.000187 |
| 1 | 1 | 2 | 0.000187 |
| 4 | 2 | 4 | 0.0015 |
| 10 | 5 | 8 | 0.0376 |
| 15 | 5 | 18 | 0.1268 |

FIG. 6A

130

| Gaming Device 1: Winning Combination: 7 7 7 | | |
|---|---|---|
| | Pre-Modification | Post-Modification |
| Probability of Generating a 7 on First Reel | 0.20 | 0.01 |
| Probability of Generating a 7 on Second Reel | 0.10 | 0.01 |
| Probability of Generating a 7 on Third Reel | 0.10 | 0.10 |
| Probability of Generating the Winning Symbol Combination of 7 7 7 | 0.002 | 0.00001 |

FIG. 6B

132

| Gaming Device 2: Winning Combination: Bar Bar Bar | | |
|---|---|---|
| | Pre-Modification | Post-Modification |
| Probability of Generating a Bar on First Reel | 0.60 | 0.05 |
| Probability of Generating a Bar on Second Reel | 0.50 | 0.02 |
| Probability of Generating a Bar on Third Reel | 0.10 | 0.01 |
| Probability of Generating the Winning Symbol Combination of Bar Bar Bar | 0.03 | 0.00001 |

FIG. 6C

134

| Gaming Device 3: Winning Combination: 7 7 7 7 7 | | |
|---|---|---|
| | Pre-Modification | Post-Modification |
| Probability of Generating a 7 on First Reel | 0.50 | 0.05 |
| Probability of Generating a 7 on Second Reel | 0.40 | 0.20 |
| Probability of Generating a 7 on Third Reel | 0.01 | 0.10 |
| Probability of Generating a 7 on Fourth Reel | 0.30 | 0.20 |
| Probability of Generating a 7 on Fifth Reel | 0.20 | 0.05 |
| Probability of Generating the Winning Symbol Combination of 7 7 7 7 7 | 0.00012 | 0.00001 |

GAMING SYSTEM WITH LINKED GAMING MACHINES THAT ARE CONFIGURABLE TO HAVE A SAME PROBABILITY OF WINNING A DESIGNATED AWARD

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which include progressive awards have become very popular. Certain known progressive slot machines contain one or more progressive awards that increase every time a player plays the slot machine. An individual progressive gaming machine has a self contained progressive award, wherein the progressive award grows with every play. A linked progressive award includes two or more gaming machines connected to a common progressive award. Each of the individual gaming machines contribute to the progressive award. The gaming machines usually add a percentage of each of the players' bets, such as 1%, to the progressive award. The progressive awards can reach sizeable amounts such as $1 million or more before a player hits or wins the progressive award. Such sizeable progressive awards are very attractive to players. Furthermore, as the progressive award grows, so does the overall average payout percentage of the gaming machine.

A typical, individual symbol driven gaming machine (such as a slot machine) has a predetermined, individual award and a predetermined probability of winning the award. The predetermined probability of winning the award is determined by a predetermined number of symbol types and a total number of symbols. This predetermined number of symbol types and total number of symbols, along with the likelihood that each such symbol will occur provide the overall predetermined probability of obtaining the predetermined, individual award of that gaming machine. This provides minimal flexibility for synchronizing gaming machines to win a designated award, such as a progressive award.

For example, Gaming Machine A has a predetermined paytable including a predetermined top award of $10,000 and a predetermined 1/1,000,000 chance of winning the top award. Gaming Machine B has a predetermined paytable including a predetermined top award of $15,000 and a predetermined 1/1,750,000 chance of winning the top award. Gaming Machine C has a predetermined paytable including a predetermined top award of $20,000 and a predetermined 1/2,000,000 chance of winning the top award. With these three gaming machines, there is no flexibility to synchronize the gaming machines to have a single designated top award. Additionally, there is no flexibility for changing the predetermined probabilities of one or more gaming machines of winning a designated award.

Typical symbol driven progressive gaming machines (such as a slot machine) have a progressive award determination driven from a predetermined number of symbol types and a total number of symbols which are part of a paytable. This predetermined number of symbol types and total number of symbols, along with the likelihood that each such symbol will occur provide a certain predetermined probability of triggering the progressive award. This provides minimal flexibility for changing the probability of generating winning symbol combinations.

In some progressive gaming systems, each of the gaming machines have the same wager requirement and include a predetermined, winning combination. Each of these winning combinations has a same probability of occurring. That is, different winning combinations at different gaming machines have a same probability of occurring and thus, winning the progressive award. However, there is not a way to modify the gaming machines to change the probabilities of winning the progressive award.

There is a need for greater flexibility in gaming systems for linking gaming machines with predetermined individual awards to a designated award for all of the gaming machines. There is a need for a gaming system and method for modifying gaming machines with different probabilities of winning a designated award such that each gaming machine has a same probability of winning the designated award. Additionally, there is a need for a gaming system and method that provides the ability to modify the probabilities of gaming machines to change the probability of one, some or all of gaming machine's probabilities of triggering a designated award based on one or more triggering events.

SUMMARY

The present disclosure relates in one embodiment to a gaming system having a central controller operable to synchronize one or a plurality of gaming machines such that each gaming machine of the gaming system has the same probability of winning a designated award. The central controller may change the probabilities of one gaming machine achieving the designated award, the probabilities of a plurality of gaming machines achieving the designated award or the probabilities of all of the gaming machines of the gaming system of achieving a designated award. The central controller may change the probabilities of achieving the designated award by changing the symbols of at least one of the gaming machines, changing the total number of symbols of at least one of the gaming machines and/or by changing the probabilities associated with the symbols of at least one of the gaming machines.

In one embodiment, a gaming system is controlled by a central controller and includes a plurality of gaming machines. Each of the gaming machines includes a game operable upon a wager by a player, a plurality of winning symbol combinations including a designated winning symbol combination and a probability of achieving the designated winning symbol combination. At least two of the gaming machines have different probabilities of achieving the designated winning symbol combination. The gaming system includes a designated award and a triggering event. After an occurrence of the triggering event, the central controller is programmed to change the probability of achieving the designated winning symbol combination for at least one of the gaming machines such that each gaming machine has an equal or substantially equal probability of generating the designated winning symbol combination and to provide the designated award to the player of the gaming machine that generates the designated winning symbol combination first. It should be appreciated that the designated award may be any suitable type of award such as a predetermined award or a progressive award.

In one embodiment, the central controller changes the symbols of one or more of the gaming machines to create substantially equal probabilities for each gaming machine to generate a designated winning symbol combination for each gaming machine to trigger or win the designated award. For example, in one embodiment, each gaming machine includes a plurality of symbols and each symbol has an equal probability of being generated. The central controller determines a designated winning symbol combination that triggers the designated award for each gaming machine. That is, each gaming device includes a designated winning symbol combination that includes a plurality of winning symbols and a plurality of non-winning symbols which are not included in the winning symbol combination. The central controller may either change (for one or more subsequent plays of a game) a non-winning symbol to one of the winning symbols to increase the probability of generating the designated winning symbol combination. To decrease the probability of generating the designated winning symbol combination for a gaming machine, the central controller (for one or more subsequent plays of a game) changes one of the winning symbols of that gaming machine to a non-winning symbol. The central controller changes at least one of the symbols of one of the gaming machines to another, different symbol to change the odds of that gaming machine winning generating the designated winning symbol combination and thus triggering the designated award.

In one embodiment, the central controller changes the number of symbols of one or more of the gaming machines to create substantially equal probabilities for each gaming machine to generate a designated winning symbol combination and trigger or win the designated award. For example, in one embodiment, each gaming machine includes a plurality of symbol generators which each include a plurality of symbols. The central controller determines a designated winning symbol combination that triggers the designated award for each gaming machine. The central controller may either add a symbol or subtract a symbol from one, a plurality or all of the symbol generators for one or more of the gaming machines to change the odds of generating the designated winning symbol combination on each gaming machine.

In one embodiment, the central controller adds a symbol to at least one gaming machine of the gaming system to change the odds of winning the designated award for that gaming machine. Adding a symbol may increase the odds of winning the designated award for that gaming machine or decrease the odds of winning the designated award for that gaming machine depending on which symbol is added. In one embodiment, the central controller determines the designated winning symbol combination for each gaming machine and adds at least one symbol of the designated winning symbol combination to at least one of the gaming machines to increase the probability of winning the designated award. In another embodiment, the gaming system adds a symbol to at least one of gaming machines that is not a part of the designated winning symbol combination to decrease the probabilities of winning the designated award. That is, if every symbol has an equal chance of being generated by the gaming machine, adding a non-winning symbol decreases the chance of generating the designated winning symbol combination. The central controller may add one or more symbols to any suitable number of gaming machines to make the probabilities substantially equal for each gaming machines to achieve, win or trigger the designated award.

In another embodiment, the central controller subtracts or removes a symbol of one, a plurality or all of the gaming machines to change the odds of winning the designated award for one, a plurality or each of the gaming machines. When each of the symbols of the gaming machines has a substantially same probability of being generated, subtracting a non-winning symbol increases the chances of generating the designated winning symbol combination. That is, when there are fewer symbols to generate, the gaming machine has a higher probability of generating a designated winning symbol combination. In one embodiment, the central controller removes one or more of the winning symbols from one of the gaming machines to decrease the odds of that gaming machine of winning the designated award.

In one embodiment of the present disclosure, the central controller changes one or more of the gaming machines by altering or changing probabilities associated with one or more symbols of that gaming machine. More specifically, the gaming system includes a plurality of gaming machines which each include a plurality of symbol generators. In one embodiment, each of the symbol generators includes a plurality of symbols and each of the symbols has a probability of being generated. The gaming system determines a designated winning combination for each of the gaming machines, each designated winning symbol combination including one or a plurality of symbols. The gaming system changes one or more of the probabilities associated with the symbols of one or more of the designated winning symbol combinations so that each gaming machine has the same probability of generating one of the designated winning symbol combinations and triggering the designated award.

In one embodiment, the central controller increases a probability of at least one symbol being generated on one of the symbol generators. In another embodiment, the central controller increases a probability of at least one symbol being generated for the overall gaming machine. The central controller may increase and/or decrease the probability of one or more symbols being generated on one or more symbol generators. The central controller may thus increase and/or decrease the probability of more than one symbol being generated on each of the symbol generators of one of the gaming machines.

It should be appreciated that the gaming system may include any combination of the above embodiments. For example, the central controller may remove a winning symbol from a first gaming machine and add a non-winning symbol to that gaming machine. For a second gaming machine, the central controller may add five winning symbols and remove a non-winning symbol and then change the probabilities of one of the winning symbols of being generated on the second gaming machine.

In an alternative embodiment, the central controller synchronizes one or a plurality of the gaming machines using virtual reel strips or virtual mapping. In one such embodiment, each of the gaming machines includes one or more symbol generators. Each of the symbol generators includes a number of stop positions or symbol positions. One or a plurality of numbers are assigned to the each stop position for each of the symbol generators of each gaming machine. The gaming system randomly selects a number for each of the symbol generators. In one embodiment, the numbers are entered into a random number generator. A random number generator selects a number for each of the symbol generators. The gaming device stops the symbol generator at the stop position associated with the selected number. For each symbol generator, each number may be entered one or more times to control the odds of each of the stop positions being selected. Thus, it should be appreciated that the odds of generating a winning combination or a designated combination associated with a designated award on one or more gaming machines may thus change based on the programming of the virtual reel strip without changing the physical appearance of any of the symbol generators. It should also be appreciated that virtual reel strips or virtual mapping may be implemented with mechanical symbol generators or virtual symbol generators.

It should be appreciated that the designated award may be any suitable type of award. In one embodiment, the designated award is a predetermined award. In another embodiment, the designated award is a progressive award, where a portion of each wager needed to initiate a game is allocated to the progressive award.

It should be appreciated that the central controller may change the odds of triggering the designated award based on any suitable triggering event. In one embodiment, the central controller changes the odds of winning the designated award for each gaming machine based on the amount of the designated award. For example, when the designated award reaches a certain amount, the probability of each gaming machine triggering the designated award is increased. In another embodiment, the central controller changes the probabilities of each gaming machine triggering the designated award based on an amount of time. For example, if the designated award is not awarded within 72 hours, the odds of triggering or winning the designated award are increased for each gaming machine. In another embodiment, the central controller changes the probabilities of each gaming machine triggering the designated award based on the number of games played on the gaming system.

It should be appreciated that in one embodiment, each of the gaming machines includes a game which is the same game pre-modification and post-modification for that gaming machine. That is, the central controller modifies the game of one or more of the gaming machines but does not change the game to an entirely different game. For example, a first gaming machine includes Game A and a second gaming machine includes Game B. Game A and Game B each include a designated winning symbol combination associated with a designated award. The central controller modifies Game A and/or Game B such that Game A and Game B have the same probability of generating each respective designated winning symbol combination. That is, Game A and/or Game B are modified so that they have the same probability of triggering a designated award but they are not changed to two, different new games. Rather, the original games (Game A and/or Game B) of each gaming machine are modified in any suitable manner.

Each gaming machine of the gaming system may have one or a plurality of different games. The games of each gaming machine may be the same games or different games. In one embodiment, only one game of a multi-game gaming machine embodiment is associated with the designated award. That is, if a gaming machine has more than one game, only one game on that gaming machine is associated with the designated award. In another embodiment, each game of the gaming system has a possibility of triggering the designated award. In one embodiment, the player is only eligible to win the designated award by wagering a designated amount, such as the maximum amount of the wager. In another embodiment, a player is only eligible to win the designated award if the player wagers a side wager or side bet.

It is therefore an advantage of the present disclosure to provide a cooperative gaming machine environment.

Another advantage of the present disclosure is to provide a central controller which enables gaming machines with different winning combinations to be linked to a designated award.

Another advantage of the present disclosure is to provide a central controller which enables any gaming machines with varying wager requirements to be linked to a designated award.

A further advantage of the present disclosure is to modify each of the gaming machines such that each gaming machine has a same probability of winning a designated award.

Additional features and advantages are described herein, and will be apparent from, the following Detailed Description and the figures.

BRIEF DESCRIPTION OF THE FIGURES

FIGS. 5A, 5B, and 5C are tables illustrating different winning combinations for three different gaming machines and how the different numbers of winning symbols on a symbol generator change the probabilities of generating a designated winning symbol combination for that gaming machine.

FIGS. 6A, 6B, and 6C are tables illustrating the pre-modification probability associated with the symbols of each of the designated winning symbol combinations of three gaming machines and the post-modification probability associated with the symbols of each of the designated winning symbol combinations for the gaming machines.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central controller remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
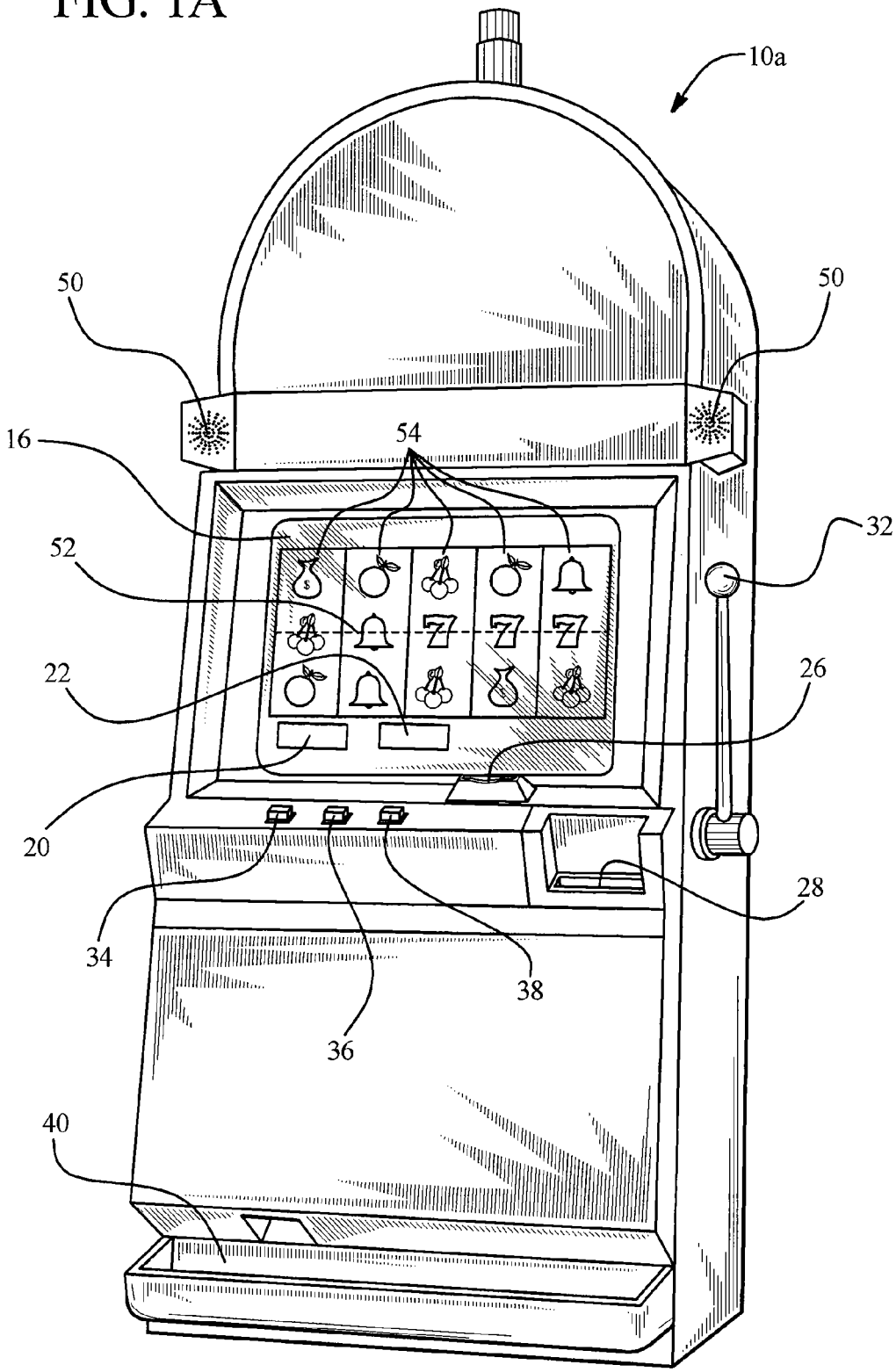
FIG. 1A is a front-side perspective view of one embodiment of the gaming device disclosed herein.
Figure 1B:
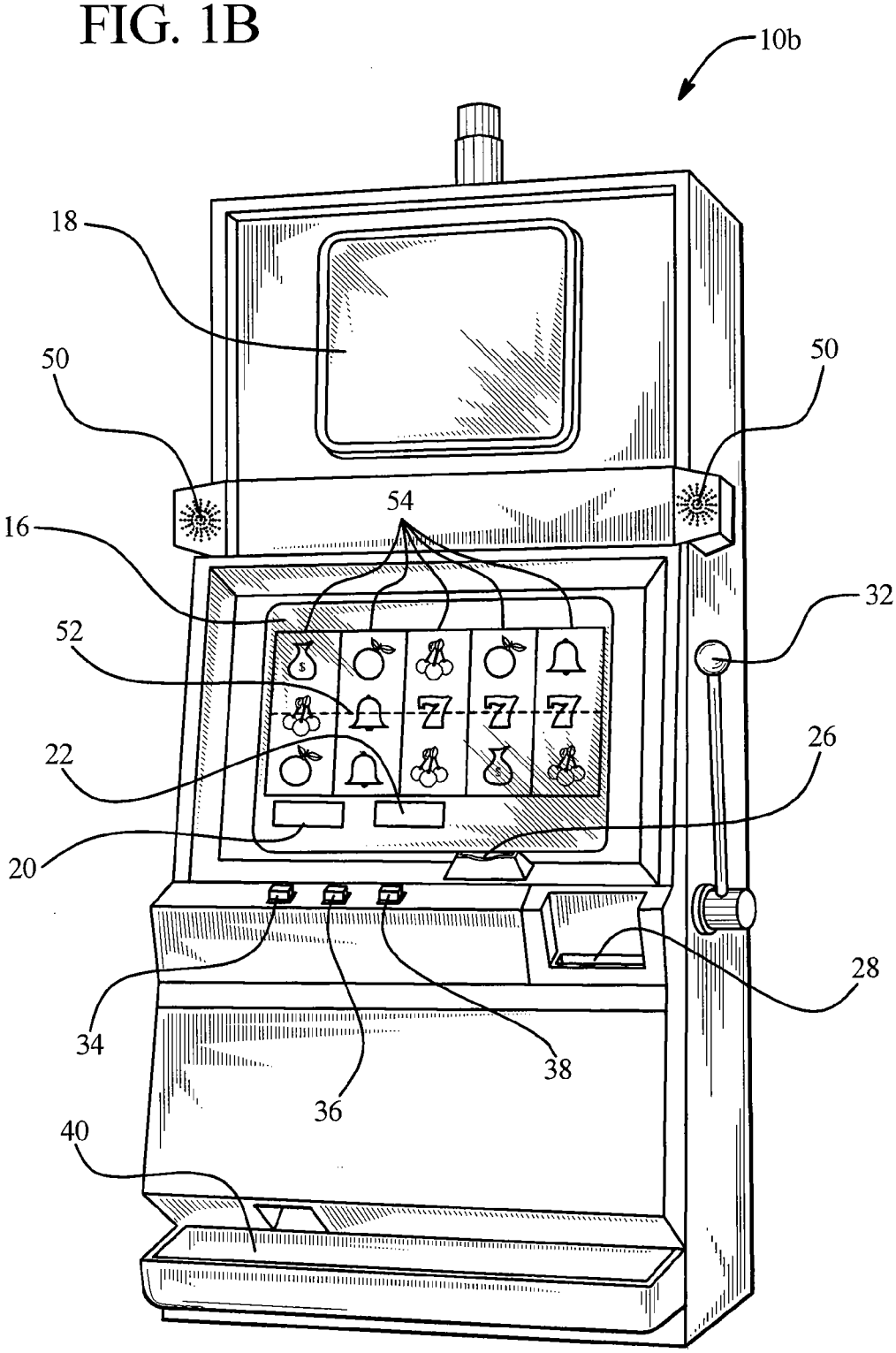
FIG. 1B is a front-side perspective view of another embodiment of the gaming device disclosed herein.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
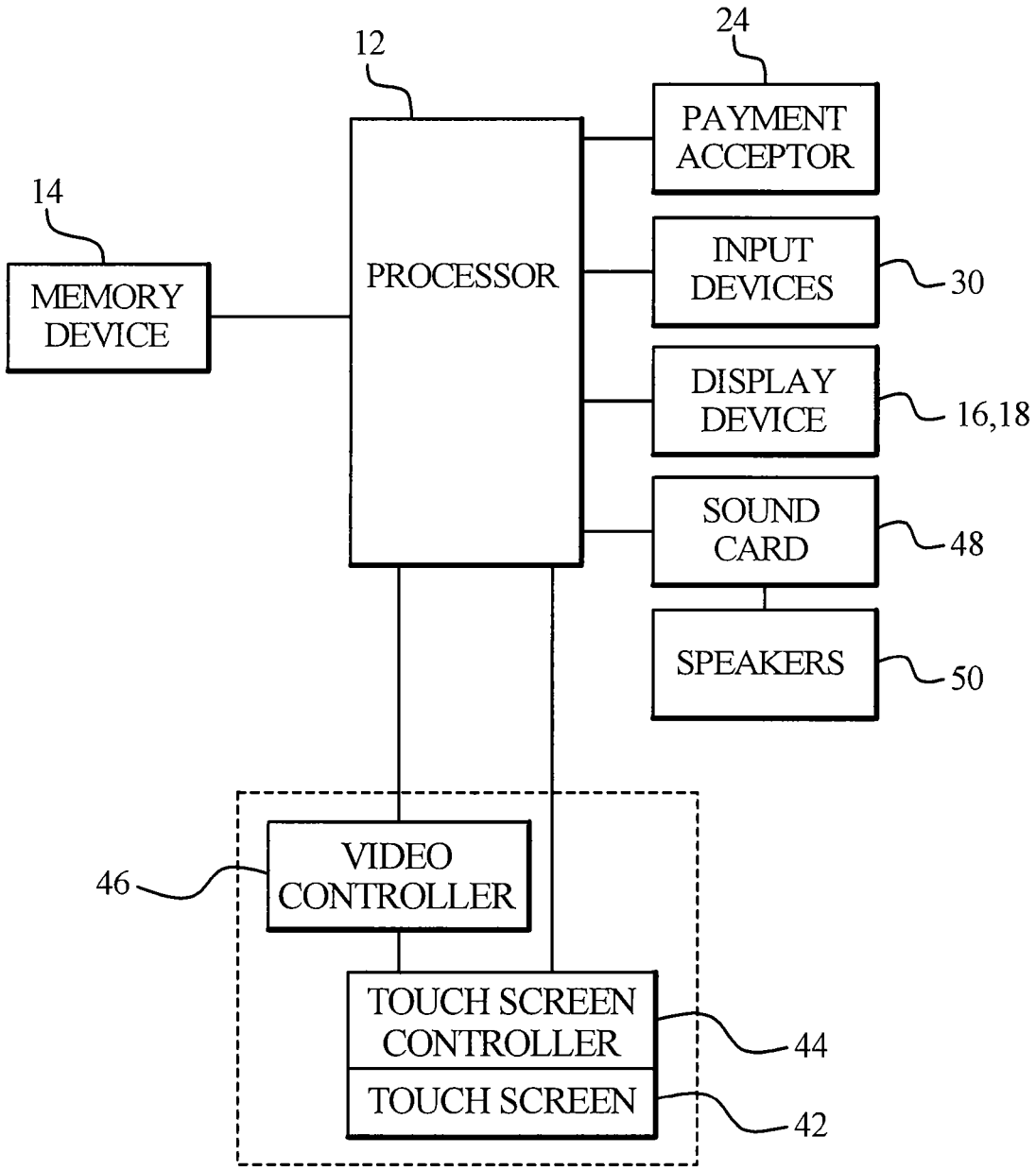
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
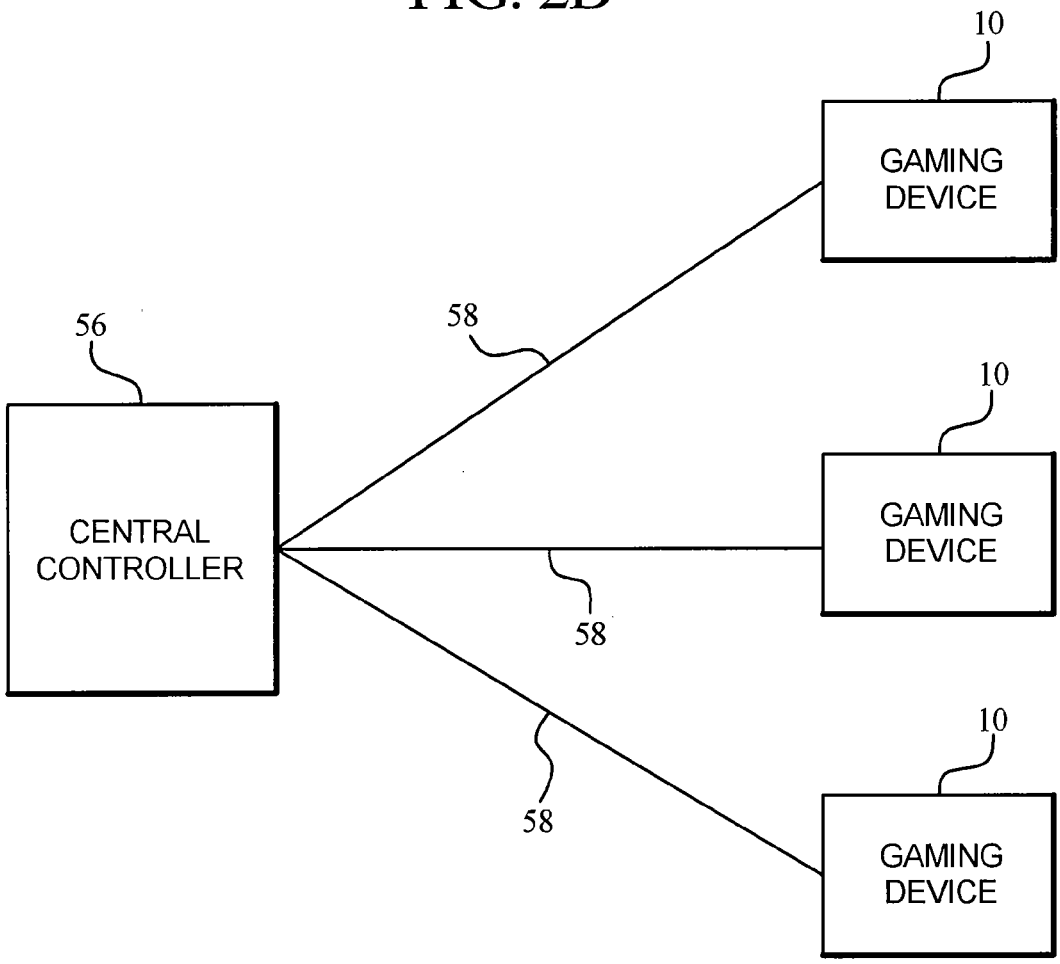
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Linked Gaming Machines that are Configurable to Have Equal Probabilities of Winning a Designated Award In one embodiment, a gaming system is controlled by a central controller and includes a plurality of gaming machines. Each of the gaming machines includes a game operable upon a wager by a player, a plurality of winning symbol combinations including a designated winning symbol combination and a probability of achieving the designated winning symbol combination. At least two of the gaming machines have different probabilities of achieving the designated winning symbol combination. The gaming system includes a designated award and a triggering event. After an occurrence of the triggering event, the central controller is programmed to change the probability of achieving the designated winning symbol combination for at least one of the gaming machines such that each gaming machine has an equal or substantially equal probability of generating the designated winning symbol combination and to provide the designated award to the player of the gaming machine that generates the designated winning symbol combination first. It should be appreciated that the designated award may be any suitable type of award.

Figure 3:
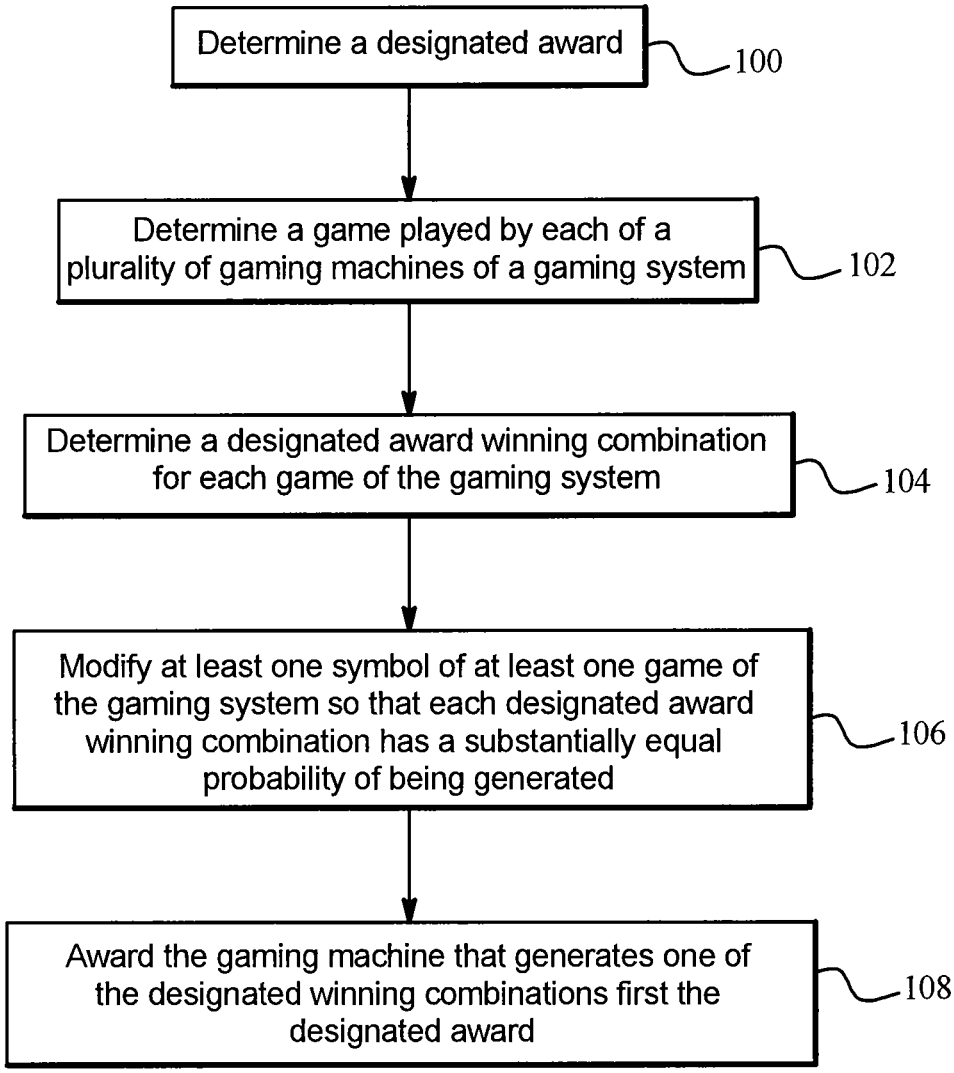
FIG. 3 is a flowchart of one embodiment of the gaming system herein disclosed illustrating the modification of at least one symbol of one gaming device so that each designated winning combination has a substantially equal probability of being generated by each of the gaming machines.

As illustrated in FIG. 3, in one embodiment, the gaming system determines a designated award for the gaming machines of the gaming system as illustrated in block 100. This award may be any suitable type of award. The gaming system determines what game is being played at each gaming machine of the gaming system as indicated in block 102. It should be appreciated that if each gaming machine includes only one game, the gaming system does not determine what game is being played at each gaming machine. The gaming system determines a designated award winning combination or winning outcome for each game of the gaming system as illustrated by block 104. As indicated in block 106, the gaming system changes at least one symbol of at least one of the games of at least one of the gaming machines so that each game has the same chance or probability of winning the designated award when a player wagers the same bet. As indicated in block 108, the gaming system awards a gaming machine that generates one of the designated winning symbol combinations first the designated award. The central controller sends a signal to the winning gaming machine causing the gaming machine to provide the award to the player.

Figure 4:
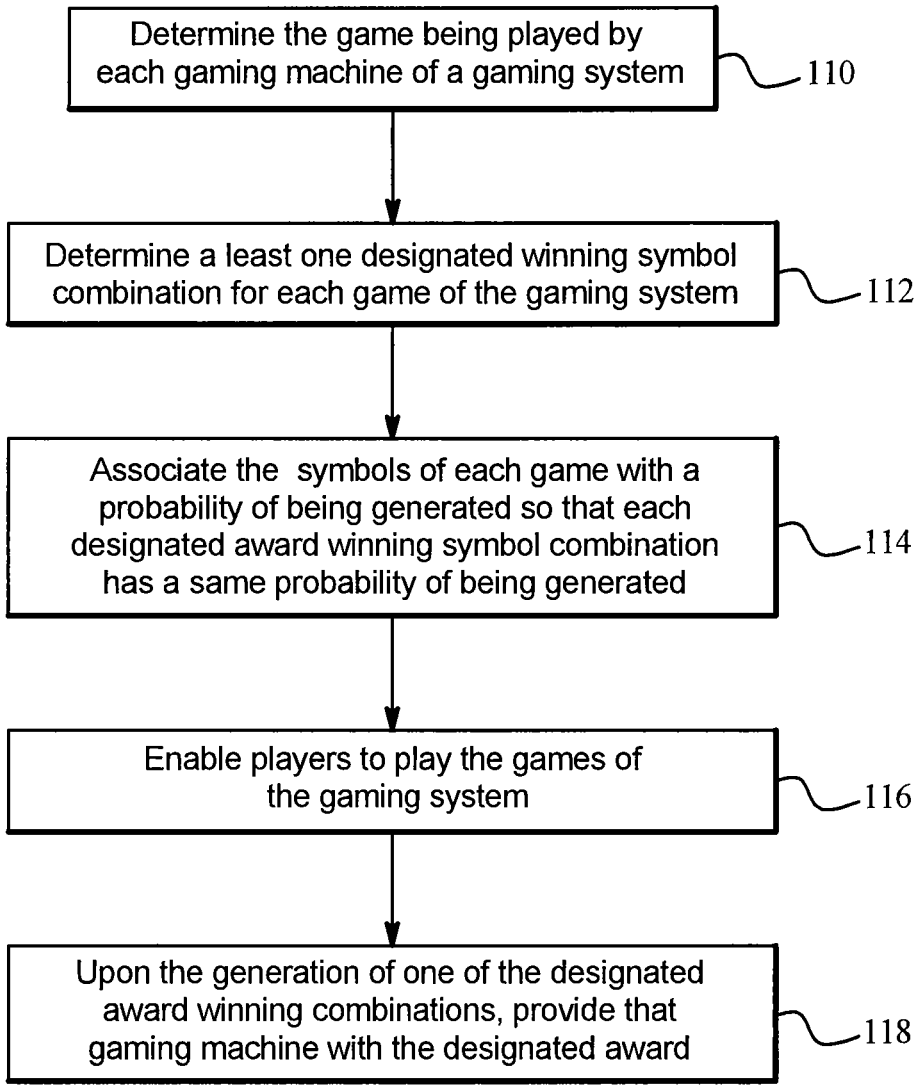
FIG. 4 is a flowchart of one embodiment of the gaming system herein disclosed illustrating the modification of a plurality of probabilities associated with symbols of at least one gaming machine so that each award winning combination has a substantially equal probability of being generated by each gaming machine.

As illustrated in FIG. 4, in one embodiment the gaming system changes the probabilities associated with one or more of the symbols of one or more of the games to create equal probabilities of triggering or winning a designated award. In this embodiment, the gaming system determines a game that is being played by each gaming machine of the gaming system as illustrated by block 110. The gaming system determines at least one winning symbol combination for each game of the gaming system as indicated by block 112. The gaming system associates the symbols of each game with a probability of being generated such that each winning combination has the same probability of being generated as indicated in block 114. The gaming system then enables the players to play the games of the gaming system as indicated in block 116. As indicated by block 118, upon generation of one of the designated award winning combinations, the gaming system provides the gaming machine that generated the designated award winning combination with the designated award and sends a signal to that gaming machine which causes that gaming machine to provide the player with the designated award.

In one embodiment, the central controller changes the number of symbols in one or more of the games therefore changing the symbols on one or more of the gaming machines. For example, in one embodiment, each gaming machine includes a plurality of symbol generators which each include a plurality of symbols. The central controller determines a winning combination or a winning symbol combination for each gaming machine. The central controller may either add a symbol or subtract a symbol from one, a plurality or all of the symbol generators for one or more of the gaming machines to change the odds of generating the winning symbol combination.

FIGS. 5A, 5B and 5C are tables illustrating the number of symbols of the determined winning combinations on each symbol generator, such as a reel, for three gaming machines. In this illustrated embodiment, each of the gaming machines has a different designated winning symbol combination for winning or triggering the designated award. Each reel of each gaming machine includes twenty-two symbols positions. It should be appreciated that the gaming system of the present disclosure may include any suitable number of symbol generators, any suitable number of gaming machines and any suitable type of winning combinations. It should be appreciated that the gaming machines may include any suitable number of symbol positions on any number of symbol generators. As illustrated in FIG. 5A, for gaming machine one, the winning combination is 7-7-7. In one embodiment, one 7 symbol is on the first reel, one 7 symbol is on the second reel, and one 7 symbol is on the third reel. If each symbol position has a same probability of being generated, the probability of winning the designated award with one 7 on each reel is 0.0000939 (1/22×1/22×1/22). Thus, if the central controller needs to increase the chance of one of the gaming machines generating the winning combination, in one embodiment, one or more of the winning symbols are added to the reels or other non-winning symbols are removed from the reels to change the overall odds for gaming machine one of generating one of the winning symbols. As illustrated in FIG. 5A, if one more 7 symbol is added to one more of the reels, gaming machine one now has a 0.000187 chance of triggering the winning combination of 7-7-7. By adding one 7 symbol to either the first reel, the second reel or the third reel, the player would have 0.000187 probability of winning the designated award at gaming machine one. Adding more 7 symbols to the reels increases the likelihood of triggering the designated award. For example, if the central controller modifies the first reel to include four 7 symbols, the second reel to include two 7 symbols and the third reel to include four 7 symbols, the probability of generating a 7-7-7 symbol combination increases to 0.0015. As indicated in the last two rows of the table of FIG. 5A, the central controller may increase/decrease the probabilities of generating the designated winning symbol combinations in any suitable manner. Gaming machine one has a 0.0376 chance of generating the designated award when the gaming machine includes ten 7 symbols on one of the reels, five 7 symbols on another one of the reels and eight 7 symbols on another one of the reels. Gaming machine one has a 0.1268 chance of generating the winning combination when one of the reels has fifteen 7 symbols, another one of the reels includes five 7 symbols and another one of the reels includes eighteen 7 symbols.

It should be appreciated that the reels may have any suitable number of symbols. It should also be appreciated that this embodiment is not limited to reels but may include any type of symbol generator and any number of symbol generators.

As illustrated in FIGS. 5B and 5C, the gaming system of the present disclosure is operable to change each of the gaming machines to have the same probability of triggering the designated winning symbol combination. The gaming system determines a designated winning symbol combination for each gaming machine. As illustrated in FIG. 5B, the designated winning symbol combination is orange-orange-orange for gaming machine two and as indicated in FIG. 5C the designated winning symbol combination for gaming machine three is bar-bar-bar. As illustrated in FIG. 5B or 5C, in one embodiment each of the gaming machines has the same number of symbols on each of the reels. For example, in FIG. 5B, if the gaming machine has one orange symbol on reel one, one orange symbol on reel two and one orange symbol on reel three, the probability of generating the designated winning symbol combination of orange-orange-orange is 0.0000939, the same as the probability of generating the 7-7-7 designated winning symbol combination for gaming machine one illustrated in FIG. 5A when each reel includes one 7 symbol on each reel. Likewise, the probability of generating the designated winning symbol combination of bar-bar-bar for gaming machine three, as illustrated in FIG. 5C, is 0.0000939 when the gaming machine includes one bar symbol on each reel. It should be appreciated that the central controller may cause any number of symbols to added or removed from the reels to change the probability of generating a designated winning symbol combination.

It should be appreciated that the designated winning combination may be any suitable combination. It should be appreciated that the designated winning symbol combination may include only a single symbol. It should also be appreciated that each designated winning symbol combination may include one or more different symbols. In one embodiment, the designated winning symbol combination depends on the location of the symbols on the reel. It should also be appreciated that the designated winning symbol combinations could be a scattered pay. It should also be appreciated that one or more gaming machines may have a different number of symbols on each of the reels. For example, one gaming machine could have twenty symbols on each of the reels and another gaming machine could have fifty symbols on each of the reels. The gaming system modifies or restructures the reel layout or the symbol position layout so that each game of the gaming system has the same probability of generating the designated winning symbol combination. In one embodiment, one or more of the gaming machines inactivate or remove one or more symbol generators, and thus change the designated winning symbol combination to change the odds of winning the designated award.

It should be appreciated that each gaming machine may include more than one game. When the gaming machine includes more than one game, the central controller may modify the selected game after the player selects the game or may modify each of the games to have the same probability of winning the designated award before the player selects the game. Therefore when a player selects one of the games, in one embodiment, the central controller then changes the symbol layout or the reel layout to make the chance of obtaining the designated award equal to all the other games in the gaming system. In another multi-game embodiment, the central controller, changes the layout or symbol layout prior to any input from a player.

It should be appreciated that in one embodiment, each of the gaming machines includes a game which is the same game pre-modification and post-modification for that gaming machine. That is, the central controller modifies the game of one or more of the gaming machines but does not change the game to an entirely different game. For example, a first gaming machine includes Game A and a second gaming machine includes Game B. Game A and Game B each include a designated winning symbol combination associated with a designated award. The central controller modifies Game A and/or Game B such that Game A and Game B have the same probability of generating each respective designated winning symbol combination. That is, Game A and/or Game B are modified so that they have the same probability of triggering a designated award but they are not changed to two, different new games. Rather, the original games (Game A and/or Game B) of each gaming machine are modified in any suitable manner. In one embodiment, Game A and Game B may remain the exact same but a designated winning combination may be added to each game that triggers the designated award. That is, all of the pre-modification winning combinations remain for Game A and Game B and the central controller adds a new designated winning combination for Game A and a new designated winning combination for Game B. Each new designated winning combination that results in the designated award.

It should be appreciated that the gaming system may change the layout of a symbol generator, such as a reel layout by removing symbols from one or more reels. Just as adding another symbol changes the probability of generating that symbol on the reel, reducing the number of non-winning symbols on a reel increases the chance of generating a winning symbol. For example, if the gaming system decreases the number of symbol positions per symbol generator from 25 symbol positions to 20 symbol positions but only removes non-winning symbols, the gaming machine has a greater probability of generating a winning symbol. That is, the probability changes from a 1/25 chance to a 1/20 chance of generating a winning symbol for each symbol generator.

In another embodiment of the present disclosure, the central controller changes the game by altering probabilities associated with symbols of one or more of the gaming machines. More specifically, the gaming system includes a plurality of gaming machines. In one embodiment, the gaming machines include a plurality of symbol generators. In one embodiment, each of the symbol generators includes a plurality of symbols and each of the symbols is associated with a probability of being generated. The gaming system determines a designated winning symbol combination for each of the gaming machines. The gaming system changes the probabilities associated with the designated winning symbol combinations so that each gaming machine has the same probability of generating one of the designated winning symbol combinations and triggering the designated award.

FIGS. 6A, 6B and 6C are tables illustrating three gaming machines of the gaming system. As illustrated, the gaming system determines a designated winning symbol combination for each of the gaming machines. As illustrated in FIG. 6A, the first gaming machine is a three reel game with a designated winning symbol combination of 7-7-7. The second gaming machine is a three reel game with a designated winning symbol combination of bar bar bar as illustrated in FIG. 6B. The third gaming machine is a five reel game with a designated winning symbol combination of 7-7-7-7-7. In one embodiment, each of the individual symbols has or is associated with a probability of being generated.

As illustrated in FIG. 6A, for the first gaming machine, prior to the modification of any of the symbol probabilities, the probability of generating a 7 symbol on the first reel is 0.20. Prior to the modification, the probability of generating a 7 symbol on the second reel is 0.10. Prior to the modification, the probability of generating a 7 symbol on the third reel is 0.10. Therefore, the probability of generating the combination of 7-7-7 on the first gaming machine prior to modification is 0.002.

As illustrated in FIG. 6A, the central controller modifies the probabilities associated with one or more symbols of the designated winning symbol combination. For example, as illustrated in FIG. 6A, after the modification, the probability of generating a 7 symbol on the first reel is 0.01. After the modification, the probability of generating a 7 symbol on the second reel is 0.01. After the modification, the probability of generating a 7 symbol on the third reel is 0.10. Therefore, the probability of generating the combination of 7-7-7 is modified to 0.00001. It should be appreciated that the central controller may modify some or all of the probabilities associated with the symbols.

As illustrated in FIG. 6B, for the second gaming machine prior to the modification, the probability of generating a bar on the first reel is 0.60. Prior to the modification, the probability of generating a bar on the second reel is 0.50. Prior to the modification, the probability of generating a bar on the third reel is 0.10. Therefore, the probability of generating the combination of bar bar bar is 0.03.

As illustrated in FIG. 6B, the central controller modifies the probabilities associated with each individual symbol or the symbol combination when it is associated with the designated winning symbol combination. For example, as illustrated in FIG. 6B, after the modification, the probability of generating a bar symbol on the first reel is 0.05. After the modification, the probability of generating a bar symbol on the second reel is 0.02. After the modification, the probability of generating a bar symbol on the third reel is 0.01. Therefore, the probability of generating the combination of bar bar bar is modified to 0.00001. The probability of achieving the winning combination associated with the designated award on the first gaming machine is equal to achieving the winning combination associated with the designated award on the second gaming machine.

As illustrated in FIG. 6C, for the third gaming machine, prior to the modification, the probability of generating a 7 symbol on the first reel is 0.50. Prior to the modification, the probability of generating a 7 symbol on the second reel is 0.40. Prior to the modification, the probability of generating a 7 symbol on the third reel is 0.01. Prior to the modification, the probability of generating a 7 symbol on the fourth reel is 0.30. Prior to the modification, the probability of generating a 7 symbol on the fifth reel is 0.20. Therefore, the probability of generating the combination of 7-7-7-7-7 is 0.00012.

As illustrated in FIG. 6C, the central controller modifies the probabilities associated with each individual symbol or the symbol combination when it is associated with or a part of the designated winning symbol combination. For example, after the modification, the probability of generating a 7 symbol on the first reel is 0.05. After the modification, the probability of generating a 7 symbol on the second reel is 0.20. After the modification, the probability of generating a 7 symbol on the third reel is 0.10. After the modification, the probability of generating a 7 symbol on the second reel is 0.20. After the modification, the probability of generating a 7 on the third reel is 0.50. Therefore, the probability of generating the combination of 7-7-7-7-7 is modified to 0.00001. The central controller modifies the probabilities associated with one or more symbols of one or more of the designated winning symbol combinations such that the probability of generating the designated winning symbol combination on each of the gaming machines is substantially equal.

It should be appreciated that the gaming machines of the gaming system may be any suitable type of gaming machine. In one embodiment, the gaming machines only include one game. In another embodiment, the gaming machines include a base game and one or more bonus games. In one such embodiment, only the bonus games are associated with the designated award.

It should be appreciated that the designated award may be any suitable type of award. In one embodiment, the designated award is a predetermined award. In another embodiment, the designated award is a physical prize. In another embodiment, the designated award is a progressive award, where a portion of each wager to initiate the game is allocated to a progressive award. For example, each gaming machine takes a percentage of the player's bet, such as 5%, and adds it to the progressive award.

The odds of winning the designated award may be changed upon any suitable triggering event. In one embodiment, the central controller changes the odds of one or more gaming machines generating the designated winning symbol combination based on the progressive award. For example, when the progressive award reaches a certain amount, the probability of each game triggering the designated award is increased. In another embodiment, the central controller changes the probabilities of each gaming machine triggering the designated award based on an amount of time. In another embodiment, the gaming system changes the chance of winning the designated award for one or more gaming machines based on the number of games played. In another embodiment, the gaming system changes the chance of winning the designated award based on an amount wagered on the gaming system.

In one embodiment, the gaming system includes a plurality of awards. In one such embodiment, each of the gaming machines has an opportunity to win each award. For example, the gaming system includes award A, award B and award C. The gaming machine alters the gaming machines so that each of the gaming machines has the same probability of winning award A, each of the gaming machines has substantially the same probability of winning award B, and each of the gaming machines has substantially the same probability of winning award C. In another embodiment, each of the gaming machines has the same probability of winning one or more but not all of the awards. For example, each of the gaming machines has the same probability of winning award A but a plurality of the gaming machines have a different probability of winning awards B and C. It should also be appreciated that each gaming machines may include awards that are unique to that gaming machines and are not shared by the gaming system.

It should be appreciated that the wager may be any type of wager. In one embodiment, the player is only eligible to win the designated award by placing the maximum bet. In one such embodiment, the gaming machines of the gaming system have different wager requirements. For example, one of the gaming machine's minimum wager is $1, another gaming machine's minimum wager is $0.25 and another gaming machine's minimum wager is $0.05. Only when a player wagers a dollar at each of the gaming machines is that player eligible to win the designated award. In this example, at the $1 minimum gaming machine, the player only needs to wager the minimum wager to be qualified to win the designated award. At the $0.25 gaming machine, the player has to wager four times the minimum award to be qualified to win the designated award. At the last gaming machine, the player has to wager twenty times the minimum wager to be qualified to win the designated award. In another embodiment, qualification to win the designated award is based on the amount wagered per payline. In another embodiment, qualification to win the designated award is based on the number of paylines wagered on. In another embodiment, the player is only eligible to win the designated award by placing a side wager. It should be appreciated that qualification to win the designated award may be based on any suitable game element.

In one embodiment, the gaming machines of the gaming system may have different wager requirements. For example, one of the gaming machine's minimum wager is $1, another gaming machine's minimum wager is $0.25 and another gaming machine's minimum wager is $0.05. In one embodiment, each of the gaming machines is modified such that each gaming machine has an equal opportunity of winning the designated award only when the player wagers a minimum designated amount. That is, only when each player wagers $1, regardless of the minimum wager requirement of each gaming machine, does that player have an equal probability of winning the designated award.

Each gaming machine may include one or more different designated winning symbol combinations. In one embodiment, the gaming system changes one or more of the designated winning symbol combinations to change the probability of winning the designated award. That is, the number of designated winning symbol combinations that are associated with the designated award may be increased, increasing the chances of winning the designated award for that gaming machine.

In another embodiment (not illustrated), the gaming system weights symbols or outcomes using a virtual reel strip for each gaming machine. In this embodiment, the gaming system only makes one random determination for each gaming machine. Each value or outcome for that gaming machine is represented by one or more positions on a virtual reel strip. In one embodiment, each of the symbols is weighted in a manner desired by a game implementer or operator. For example, the implementer may wish to have certain a symbol generated randomly twenty percent of the time on that gaming machine, another symbol generated randomly thirty percent of the time and another symbol generated randomly fifty percent of the time. In one embodiment, each of the positions or stops of the virtual reel strip is as likely to be generated (by a random outcome generator) as any other position. Therefore, by changing the number of times a symbol is associated with one of the stops of the virtual reel strip, the probabilities associated with generating that symbol for that gaming machine change. It should be appreciated that the virtual reel strip may include any suitable number of stops or positions. In one embodiment, the values or outcomes of the game are represented on the virtual reel strip by numbers such as 1, 2, 3, 4, etc.

Though most regulations prohibit changing the odds or probabilities of card games, it should be appreciated that the present disclosure could be applied to card games as well.

It should thus be appreciated that in one embodiment, a gaming system includes a central controller and a first gaming machine operable to communicate with the central controller. The first gaming machine includes a first winning symbol combination having a first probability of being generated and a different second winning symbol combination having a second probability of being generated. The gaming system includes a second gaming machine operable to communicate with the central controller. The second gaming machine includes a first winning symbol combination having a first probability of being generated and a different second winning symbol combination having a second probability of being generated. The central controller is programmed to cause a change of either: one of the first probability of the first gaming machine or the second probability of the first gaming machine, such that the other of the first probability of the first gaming machine or the second probability of the first gaming machine remains unchanged or one of the first probability of the second gaming machine or the second probability of the second gaming machine, such that the other of the first probability of the second gaming machine or the second probability of the second gaming machine remains unchanged.

In the above embodiment, it should be appreciated that the central controller may be programmed to cause:

(a) the first probability of the first gaming machine to change to the second probability of the first gaming machine;

(b) the second probability of the first gaming machine to change to the first probability of the first gaming machine;

(c) the first probability of the second gaming machine to change to the second probability of the second gaming machine;

(d) the second probability of the second gaming machine to change to the first probability of the second gaming machine;

(e) the first probability of the first gaming machine to change to the first probability of the second gaming machine;

(f) the first probability of the first gaming machine to change to the second probability of the second gaming machine;

(g) the second probability of the first gaming machine to change to the first probability of the second gaming machine;

(h) the second probability of the first gaming machine to change to the second probability of the second gaming machine;

(i) the first probability of the second gaming machine to change to the first probability of the first gaming machine;

(j) the first probability of the second gaming machine to change to the second probability of the first gaming machine;

(k) the second probability of the second gaming machine to change to the first probability of the first gaming machine; and (l) the second probability of the second gaming machine to change to the second probability of the first gaming machine.

It should also be appreciated that in another embodiment, a gaming system includes a central controller and a first gaming machine operable to communicate with the central controller. The first gaming machine includes (a) a first winning symbol combination associated with a designated award and having a first probability of being generated; (b) a second winning symbol combination associated with the designated award and having a second probability of being generated; and (c) a first overall probability of generating the designated award based on the first probability and second probability. The gaming system includes a second gaming machine operable to communicate with the central controller. The second gaming machine includes: (a) a first winning symbol combination associated with the designated award and having a first probability of being generated; (b) a second winning symbol combination associated with the designated award and having a second probability of being generated; and (c) a second overall probability of generating the designated award based on the first probability and second probability. The first overall probability is different than the second overall probability. The gaming system includes a central controller programmed to cause the change of at least one of: (i) the first probability or the second probability of the first gaming machine, and (ii) the first probability or the second probability of the second gaming machine, such that the first gaming machine and the second gaming machine have an equal or substantially equal probability of generating the designated award.

It should be appreciated that in various embodiments disclosed herein, a gaming system includes a central controller which is operable to check each of the gaming machines to determine whether they have a same or different probability of winning an award. That is, the central controller has a checking routine which determine if different gaming machines have same or different probabilities of generating an award. In one such embodiment, if the gaming machines have different probabilities of winning the award, the central controller is operable to change one or more probabilities associated with one or more symbol combinations of one or more of the gaming machines such that a plurality or all of the gaming machines have an equal or substantially equal probability of generating or achieving the award.

It should further be appreciated that in another embodiment, a gaming system includes a central controller, a designated award and a first gaming machine operable to communicate with the central controller. The first gaming machine includes a first winning symbol combination having a first probability of being generated and a second winning symbol combination having a second probability of being generated. The gaming system includes a second gaming machine operable to communicate with the central controller. The second gaming machine includes a first winning symbol combination having a first probability of being generated and a second winning symbol combination having a second probability of being generated. The central controller is programmed to cause the change of at least one of: (i) the first probability or the second probability of the first gaming machine; and (ii) the first probability or the second probability of the second gaming machine, such that the first gaming machine and the second gaming machine have an equal or substantially equal probability of generating the designated award. It should be appreciated that there may be one or a plurality of designated awards.

It should be appreciated that in this embodiment, the central controller may be programmed to cause:

(a) the first probability of the first gaming machine to change to the second probability of the first gaming machine;

(b) the second probability of the first gaming machine to change to the first probability of the first gaming machine;

(c) the first probability of the second gaming machine to change to the second probability of the second gaming machine;

(d) the second probability of the second gaming machine to change to the first probability of the second gaming machine;

(e) the first probability of the first gaming machine to change to the first probability of the second gaming machine;

(f) the first probability of the first gaming machine to change to the second probability of the second gaming machine;

(g) the second probability of the first gaming machine to change to the first probability of the second gaming machine;

(h) the second probability of the first gaming machine to change to the second probability of the second gaming machine;

(i) the first probability of the second gaming machine to change to the first probability of the first gaming machine;

(j) the first probability of the second gaming machine to change to the second probability of the first gaming machine;

(k) the second probability of the second gaming machine to change to the first probability of the first gaming machine; and (l) the second probability of the second gaming machine to change to the second probability of the first gaming machine.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming system comprising:

a central controller programmed to:

(i) determine information associated with a first existing gaming machine;

(ii) determine information associated with a second existing gaming machine, wherein the second existing gaming machine and the first existing gaming machine have different or substantially different probabilities of generating a designated award;

iii) after determining said information associated with the first existing gaming machine and the second existing gaming machine, when, for a wager amount placed at the existing gaming machine, the first existing gaming machine includes:

(a) a first winning symbol combination having a thirst probability of being generated, and (b) a different second winning symbol combination having a second probability of being generated; and when, for the wager amount placed at the second existing gaming machine, the second existing gaming machine includes:

(a) a third winning symbol combination having a third probability of being generated, and (b) a different fourth winning symbol combination having a fourth probability of being generated, said fourth winning symbol combination being different than said first winning symbol combination and the second winning symbol combination;

cause a change of at least one of:

(a) one of the first probability of the first existing gaming machine or the second probability of the first existing gaming machine, such that the other of the first probability of the first existing gaming machine or the second probability of the first existing gaming machine remains unchanged; and (b) one of the third probability of the second existing gaming machine or the fourth probability of the second gaming machine, such that the other of the third probability of the second gaming machine or the fourth probability of the second gaming machine remains unchanged, such that one of the first probability of the first existing gaming machine or the second probability of the first existing gaming machine is equal or substantially equal to one of the third probability of the second existing gaming machine or the fourth probability of the second gaming machine and the first existing gaming machine and the second existing gaming machine have an equal or substantially equal probability of generating the designated award.

2. The gaming system of claim 1, wherein the central controller is programmed to cause the first probability of the first existing gaming machine to change to the second probability of the first existing gaming machine.

3. The gaming system of claim 1, wherein the central controller is programmed to cause the second probability of the first existing gaming machine to change to the first probability of the first existing gaming machine.

4. The gaming system of claim 1, wherein the central controller is programmed to cause the third probability of the second existing gaming machine to change to the fourth probability of the second existing gaming machine.

5. The gaming system of claim 1, wherein the central controller is programmed to cause the fourth probability of the second existing gaming machine to change to the third probability of the second existing gaming machine.

6. The gaming system of claim 1, wherein the central controller is programmed to cause the first probability of the first existing gaming machine to change to the third probability of the second existing gaming machine.

7. The gaming system of claim 1, wherein the central controller is programmed to cause the first probability of the first existing gaming machine to change to the fourth probability of the second existing gaming machine.

8. The gaming system of claim 1, wherein the central controller is programmed to cause the second probability of the first existing gaming machine to change to the third probability of the second existing gaming machine.

9. The gaming system of claim 1, wherein the central controller is programmed to cause the second probability of the first existing gaming machine to change to the fourth probability of the second existing gaming machine.

10. The gaming system of claim 1, wherein the central controller is programmed to cause the third probability of the second existing gaming machine to change to the first probability of the first existing gaming machine.

11. The gaming system of claim 1, wherein the central controller is programmed to cause the third probability of the second existing gaming machine to change to the second probability of the first existing gaming machine.

12. The gaming system of claim 1, wherein the central controller is programmed to cause the fourth probability of the second existing gaming machine to change to the first probability of the first existing gaming machine.

13. The gaming system of claim 1, wherein the central controller is programmed to cause the fourth probability of the second existing gaming machine to change to the second probability of the first existing gaming machine.

14. A gaming system comprising:

a central controller programmed to:

(i) determine information associated with a first existing gaming machine;

(ii) determine information associated with a second existing gaming machine, wherein the second existing gaming machine and the first existing gaming machine have different or substantially different probabilities of generating a designated award;

(iii) after determining said information associated with the first existing gaming machine and the second existing gaming machine, when, for a wager amount placed at the first existing gaming machine, the first existing gaming machine includes:

(a) a first winning symbol combination having a first probability of being generated, and (b) a second winning symbol combination having a second probability of being generated; and when, for the wager amount placed at the second existing gaming machine, the second gaming machine includes:

(a) a third winning symbol combination having a third probability of being generated, and (b) a fourth winning symbol combination having a fourth probability of being generated, link said first existing gaming machine and said second gaming machine to the designated award by causing a change of at least one of:

(a) the first probability or the second probability of the first existing gaming machine, and (b) the third probability or the fourth probability of the second gaming machine, such that the first existing gaming machine and the second existing gaming machine have an equal or substantially equal probability of generating the designated award.

15. The gaming system of claim 14, wherein the central controller is programmed to cause the first probability of the first existing gaming machine to change to the second probability of the first existing gaming machine.

16. The gaming system of claim 14, wherein the central controller is programmed to cause the second probability of the first existing gaming machine to change to the first probability of the first existing gaming machine.

17. The gaming system of claim 14, wherein the central controller is programmed to cause the third probability of the second existing gaming machine to change to the fourth probability of the second existing gaming machine.

18. The gaming system of claim 14, wherein the central controller is programmed to cause the fourth probability of the second existing gaming machine to change to the third probability of the second existing gaming machine.

19. The gaming system of claim 14, wherein the central controller is programmed to cause the first probability of the first existing gaming machine to change to the third probability of the second existing gaming machine.

20. The gaming system of claim 14, wherein the central controller is programmed to cause the first probability of the first existing gaming machine to change to the fourth probability of the second existing gaming machine.

21. The gaming system of claim 14, wherein the central controller is programmed to cause the second probability of the first existing gaming machine to change to the third probability of the second existing gaming machine.

22. The gaming system of claim 14, wherein the central controller is programmed to cause the second probability of the first existing gaming machine to change to the fourth probability of the second existing gaming machine.

23. The gaming system of claim 14, wherein the central controller is programmed to cause the third probability of the second existing gaming machine to change to the first probability of the first existing gaming machine.

24. The gaming system of claim 14, wherein the central controller is programmed to cause the third probability of the second existing gaming machine to change to the second probability of the first existing gaming machine.

25. The gaming system of claim 14, wherein the central controller is programmed to cause the fourth probability of the second existing gaming machine to change to the first probability of the first existing gaming machine.

26. The gaming system of claim 14, wherein the central controller is programmed to cause the fourth probability of the second existing naming machine to change to the second probability of the first existing gaming machine.

27. A method of operating a gaming system, said method comprising:

(i) causing a central controller to:

(a) determine information associated with a first existing gaming machine, and (b) determine information from associated with a second existing gaming machine, wherein the second existing gaming machine and the first existing gaming machine have different or substantially different probabilities of generating a designated award; and (ii) after determining said information associated with the first existing gaming machine and the second existing gaming machine, when, for a wager amount placed at the first existing gaming machine, the first existing gaming machine includes:

(a) a first winning symbol combination having a first probability of being generated, and (b) a different second winning symbol combination having a second probability of being generated, and when, for the wager amount placed at the second existing gaming machine, the second existing gaming machine includes:

(a) a third winning symbol combination having a third probability of being generated, and (b) a different fourth winning symbol combination having a fourth probability of being generated, said fourth winning symbol combination being different than said first winning symbol combination of the first existing gaming machine and the second winning symbol combination of the first existing gaming machine;

causing the central controller to change of at least one of:

(a) one of the first probability of the first existing gaming machine or the second probability of the first existing gaming machine, such that the other of the first probability of the first existing gaming machine or the second probability of the first existing gaming machine remains unchanged; and (b) one of the third probability of the second existing gaming machine or the fourth probability of the second existing gaming machine, such that the other of the third probability of the second existing gaming machine or the fourth probability of the second gaming machine remains unchanged, and such that one of the first probability of the first existing gaming machine or the second probability of the first existing gaming machine is equal or substantially equal to one of the third probability of the second gaming machine or the fourth probability of the second gaming machine and first existing substantially equal probability of generating the designated award.

28. The method of claim 27, which includes changing the first probability of the first existing gaming machine to the second probability of the first existing gaming machine.

29. The method of claim 27, which includes changing the second probability of the first existing gaming machine to the first probability of the first existing gaming machine.

30. The method of claim 27, which includes changing the third probability of the second existing gaming machine to the fourth probability of the second existing gaming machine.

31. The method of claim 27, which includes changing the fourth probability of the second existing gaming machine to the third probability of the second existing gaming machine.

32. The method of claim 27, which includes changing the first probability of the first existing gaming machine to the third probability of the second existing gaming machine.

33. The method of claim 27, which includes changing the first probability of the first existing gaming machine to the fourth probability of the second existing gaming machine.

34. The method of claim 27, which includes changing the second probability of the first existing gaming machine to the third probability of the second existing gaming machine.

35. The method of claim 27, which includes changing the second probability of the first existing gaming machine to the fourth probability of the second existing gaming machine.

36. The method of claim 27, which includes changing the third probability of the second existing gaming machine to the first probability of the first existing gaming machine.

37. The method of claim 27, which includes changing the third probability of the second existing gaming machine to the second probability of the first existing gaming machine.

38. The method of claim 27, which includes changing the fourth probability of the second existing gaming machine to the first probability of the first existing gaming machine.

39. The method of claim 27, which includes changing the fourth probability of the second existing gaming machine to the second probability of the first existing gaming machine.

40. The method of claim 27, which is provided through a data network.

41. The method of claim 40, wherein the data network is the internet.

42. A method of operating a gaming system, said method comprising:

(i) causing a central controller to:

(a) determine information associated with a first existing gaming machine;

(b) determine information associated with a second existing gaming machine, wherein the second existing gaming machine and the first existing gamin machine have different or substantially different probabilities of generating a designated award;

(ii) after determining said information associated with the first existing gaming machine and the second existing gaming machine, when, for a wager amount placed at the first existing gaming machine, the first existing gaming machine includes:

(a) a first winning symbol combination having a first probability of being generated, and (b) a second winning symbol combination having a second probability of being generated, and when, for the wager amount placed at the second existing gaming machine, the second existing gaming machine includes:

(a) a third winning symbol combination having a third probability of being generated, and (b) a fourth winning symbol combination having a fourth probability of being generated, and causing the central controller to link said first existing gaming machine and said second gaming machine to the designated award by causing at least one of the first probability or the second probability for the first existing gaming machine or the third probability or the fourth probability of the second existing gaming machine to change, such that the first gaming machine and the second gaming machine have an equal or substantially equal probability of achieving the designated award.

43. The method of claim 42, which includes changing the first probability of the first existing gaming machine to the second probability of the first existing gaming machine.

44. The method of claim 42, which includes changing the second probability of the first existing gaming machine to the first probability of the first existing gaming machine.

45. The method of claim 42, which includes changing the third probability of the second existing gaming machine to the fourth probability of the second existing gaming machine.

46. The method of claim 42, which includes changing the fourth probability of the second existing gaming machine to the third probability of the second existing gaming machine.

47. The method of claim 42, which includes changing the first probability of the first existing gaming machine to the third probability of the second existing gaming machine.

48. The method of claim 42, which includes changing the first probability of the first existing gaming machine to the fourth probability of the second existing gaming machine.

49. The method of claim 42, which includes changing the second probability of the first existing gaming machine to the third probability of the second existing gaming machine.

50. The method of claim 42, which includes changing the second probability of the first existing gaming machine to the fourth probability of the second existing gaming machine.

51. The method of claim 42, which includes changing the third probability of the second existing gaming machine to the first probability of the first existing gaming machine.

52. The method of claim 42, which includes changing the third probability of the second existing gaming machine to the second probability of the first existing gaming machine.

53. The method of claim 42, which includes changing the fourth probability of the second existing gaming machine to the first probability of the first existing gaming machine.

54. The method of claim 42, which includes changing the fourth probability of the second existing gaming machine to the second probability of the first existing gaming machine.

55. The method of claim 42, which is provided through a data network.

56. The method of claim 55, wherein the data network is the internet.

* * * * *

UNITED STATES PATENT AND TRADEMARK OFFICE

CERTIFICATE OF CORRECTION

PATENT NO. : 8,512,130 B2
APPLICATION NO. : 11/460490
DATED : August 20, 2013
INVENTOR(S) : David H. Muir It is certified that error appears in the above-identified patent and that said Letters Patent is hereby corrected as shown below:

IN THE CLAIMS

In Claim 1, Column 31, Line 3, after ";" insert --and--.
In Claim 1, Column 31, Line 4, replace "iii)" with --(iii)--.
In Claim 1, Column 31, Line 7, between "the" and "existing" insert --first--.
In Claim 1, Column 31, Line 9, replace "thirst" with --first--.
In Claim 1, Column 31, Line 26, replace "or" with --and--.
In Claim 1, Column 31, Line 29, replace "or" with --and--.
In Claim 1, Column 31, Line 32, replace "or" with --and--.
In Claim 1, Column 31, Line 33, between "second" and "gaming" insert --existing--.
In Claim 1, Column 31, Line 34, between "second" and "gaming" insert --existing--.
In Claim 1, Column 31, Line 34, replace "or" with --and--.
In Claim 1, Column 31, Line 38, replace "or" with --and--.
In Claim 1, Column 31, Line 41, replace "or" with --and--.
In Claim 1, Column 31, Line 42, between "second" and "gaming" insert --existing--.
In Claim 14, Column 32, Line 36, after ";" insert --and--.
In Claim 14, Column 32, Line 47, between "second" and "gaming" insert --existing--.
In Claim 14, Column 32, Lines 53 to 54, between "second" and "gaming" insert --existing--.
In Claim 14, Column 32, Line 59, between "second" and "gaming" insert --existing--.
In Claim 27, Column 33, Line 51, delete "from".
In Claim 27, Column 34, Line 12, replace "or" with --and--.
In Claim 27, Column 34, Line 14, replace "or" with --and--.
In Claim 27, Column 34, Line 18, replace "or" with --and--.
In Claim 27, Column 34, Line 21, replace "or" with --and--.
In Claim 27, Column 34, Line 22, between "second" and "gaming" insert --existing--.
In Claim 27, Column 34, Line 24, replace "or" with --and--.
In Claim 27, Column 34, Line 26, between "second" and "gaming" insert --existing--.
In Claim 27, Column 34, Line 26, replace "or" with --and--.
In Claim 27, Column 34, Line 27, between "second" and "gaming" insert --existing--.

Signed and Sealed this
Twenty-ninth Day of July, 2014

Michelle K. Lee

Michelle K. Lee
*Deputy Director of the United States Patent and Trademark Office*

IN THE CLAIMS

In Claim 41, Column 35, Line 2, replace “the” with --an--.
In Claim 42, Column 35, Line 10, replace “gamin” with --gaming--.
In Claim 42, Column 35, Line 12, after “;” insert --and--.
In Claim 43, Column 35, Line 30, between “second” and “gaming” insert --existing--.
In Claim 43, Column 35, Line 33, replace “or” with --and--.
In Claim 43, Column 35, Line 36, between “first” and “gaming” insert --existing--.
In Claim 43, Column 35, Line 36, between “second” and “gaming” insert --existing--.

UNITED STATES PATENT AND TRADEMARK OFFICE

CERTIFICATE OF CORRECTION

PATENT NO. : 8,512,130 B2
APPLICATION NO. : 11/460490
DATED : August 20, 2013
INVENTOR(S) : Muir It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1637 days.

Signed and Sealed this
Twenty-seventh Day of January, 2015

Michelle K. Lee

Michelle K. Lee
*Deputy Director of the United States Patent and Trademark Office*